US012773022B2

(12) United States Patent
McLachlan et al.

(10) Patent No.: US 12,773,022 B2
(45) Date of Patent: Oct. 27, 2026

(54) COVERALL HAVING MULTIPLE SAFETY RING SLEEVES WITH ELASTICIZED CUFFS

(71) Applicant: DUPONT SAFETY & CONSTRUCTION, INC., Wilmington, DE (US)

(72) Inventors: Colin McLachlan, Sumter, SC (US); Judith Lee Denny-Lybbert, West Columbia, SC (US); Arthur Harrison Monk, Columbia, SC (US)

(73) Assignee: DUPONT SAFETY & CONSTRUCTION, INC., Wilmington, DE (US)

( * ) Notice: Subject to any disclaimer, the term of this patent is extended or adjusted under 35 U.S.C. 154(b) by 69 days.

(21) Appl. No.: 18/419,198

(22) Filed: Jan. 22, 2024

(65) Prior Publication Data

US 2024/0245149 A1 Jul. 25, 2024

Related U.S. Application Data

(60) Provisional application No. 63/591,251, filed on Oct. 18, 2023, provisional application No. 63/440,546, filed on Jan. 23, 2023.

(51) Int. Cl.

| | |
|---|---|
| ***A41D 13/02*** | (2006.01) |
| ***A41D 13/00*** | (2006.01) |
| ***A41D 27/10*** | (2006.01) |

(52) U.S. Cl.

CPC ..... *A41D 13/02* (2013.01); *A41D 13/0007* (2013.01); *A41D 27/10* (2013.01); *A41D 2200/20* (2013.01); *A41D 2300/22* (2013.01)

(58) Field of Classification Search

CPC ..... A41D 13/02; A41D 13/0007; A41D 2600/20; A41D 27/10

See application file for complete search history.

(56) References Cited

U.S. PATENT DOCUMENTS 3,292,179 A * 12/1966 Iacono, Jr. ..... A62B 17/005 2/457

4,214,321 A 7/1980 Nuwayser (Continued)

FOREIGN PATENT DOCUMENTS

| | | | |
|---|---|---|---|
| CA | 2461829 | A1 | 9/2005 |
| JP | 2020133080 | A | 8/2020 |
| WO | 2001/012267 | A1 | 2/2001 |

OTHER PUBLICATIONS

PCT International Search Report for Application No. PCT/US2024/012315; Frank van Voorst, Authorized Officer; ISA/EPO; Jun. 18, 2024.

*Primary Examiner* — Alissa L Hoey
*Assistant Examiner* — Akwokwo Olabisi Redhead

(57) ABSTRACT

Protective coverall suitable for use over a body harness, the body harness having a plurality of safety rings, the body harness being worn by a person to support that person with safety lines or ropes attached to that body harness during an activity or if the person should fall, the protective coverall having a body portion having a plurality of openings for a person's limbs, along with the associated sleeves for receiving the arms and legs of the person, the body portion additionally having a plurality of safety ring openings with each safety ring opening provided with a safety ring sleeve for receiving a safety ring attached to the body harness, each safety ring sleeve further ending in an elasticized cuff.

28 Claims, 18 Drawing Sheets

(56) References Cited

U.S. PATENT DOCUMENTS

| | | | | | |
|---|---|---|---|---|---|
| 4,272,851 | A | | 6/1981 | Goldstein | |
| 4,731,882 | A | * | 3/1988 | Ekman | A41D 13/0007 2/69 |
| 4,772,510 | A | | 9/1988 | McClure | |
| 4,833,010 | A | | 5/1989 | Langley | |
| 4,855,178 | A | | 8/1989 | Langley | |
| 4,920,575 | A | | 5/1990 | Bartasis et al. | |
| 5,005,218 | A | * | 4/1991 | Ganz | A41D 27/08 2/244 |
| 5,035,941 | A | | 7/1991 | Blackburn | |
| 5,162,148 | A | | 11/1992 | Boye et al. | |
| 5,245,993 | A | * | 9/1993 | McGrady | A42B 3/28 2/205 |
| 5,548,842 | A | | 8/1996 | Wiseman, Sr. | |
| 5,626,947 | A | | 5/1997 | Hauer et al. | |
| 5,960,480 | A | * | 10/1999 | Neustater | A62B 35/04 2/456 |
| 6,658,666 | B2 | | 12/2003 | Schweer | |
| 6,698,026 | B2 | | 3/2004 | Schweer | |
| 6,892,395 | B2 | | 5/2005 | Schweer | |
| 11,103,017 | B2 | | 8/2021 | Samaniego et al. | |
| 2018/0352878 | A1 | * | 12/2018 | Smith | A41D 13/0005 |
| 2019/0069610 | A1 | | 3/2019 | Samaniego et al. | |
| 2020/0060357 | A1 | * | 2/2020 | Duran | A41D 1/02 |
| 2022/0061416 | A1 | * | 3/2022 | Zeppetella | A41D 13/0007 |

* cited by examiner

COVERALL HAVING MULTIPLE SAFETY RING SLEEVES WITH ELASTICIZED CUFFS

BACKGROUND OF THE INVENTION

Field of the Invention

This relates to a coverall suitable for use over a body harness, the body harness being worn by a person to assist or support that person with one or more lines or ropes attached to that body harness during an activity or if the person should fall, with the body harness having a plurality of safety rings suitable for attaching the body harness to a plurality of lines or ropes, wherein the coverall is provided with a plurality of protective sleeves specifically designed to allow the safety rings that are attached to the body harness to be available to the exterior environment of the coverall and be held in place by an elasticized cuff at the end of each protective sleeve, so that the safety rings are available for attachment to safety lines or ropes while protecting both the straps of body harness and the wearer from the environment.

DESCRIPTION OF RELATED ART

Garments having a single conduit in the back for the passage of an exterior safety support rope from the exterior to the interior of the garment, for the purpose of attaching the support rope to an internal safety harness worn by a worker, are known. Representative publications include U.S. Pat. Nos. 5,548,842 to Wiseman and 11,103,017 to Samaniego et al.

Body harnesses that have a single attachment ring in the back are normally used to support the body during and after the arrest of a fall. However, a person during hobby activity or a worker during work (person, worker, and wearer are used interchangeably herein) may face multiple situations where exterior support is needed, and there are multiple types of body harnesses for such situations. For example, there are body harnesses with attachment rings located on the front that are designed for suspension or controlled decent of the wearer from a height or are used with various fall restrict systems when the wearer is climbing. There are body harnesses that have attachment rings in the shoulder area that are designed to support a wearer in a position that reduces the wearer's profile during passage through a limited access area, as when hoisting a person upward through a vertical passage. Additionally, there are body harnesses that have attachment rings at the waist area that are designed to horizontally position and/or stabilize a person.

It is possible a person may wear a body harness that has multiple attachment rings in various locations so that the person can be attached with multiple safety ropes or lines for multiple types of support. For example, a person may need to wear a body harness that is simultaneously attached to a first safety line in the back for emergency fall support, a second safety line in the front for vertical movement, with two additional safety lines opposingly attached at the hips for horizontal positioning. Additionally, workers also need protective apparel to protect the worker from hazards in the environment. Wearing the body harness over a protective garment is not a desirable situation in that body harnesses are generally more expensive than the protective garment, and the body harnesses can become compromised with each successive exposure to a hazardous or dirty environment. Therefore, it is desirable to have no exposure of the body harness straps to a hazardous or dirty environment, especially the straps of the body harness that attach the safety rings to the harness. What is needed therefore, is a protective garment, particularly a coverall, that can be worn over a body harness that protects not only the worker, but also protects the body harness straps from any hazards or particulate that are external to the coverall.

BRIEF SUMMARY OF THE INVENTION

This invention relates to protective coverall suitable for use over a body harness worn by a person to support that person with safety lines or ropes attached to that body harness during an activity or if the person should fall,

- with the body harness having a plurality of safety rings suitable for attaching the body harness to a plurality of lines or ropes, the body harness having an upper front area worn on an upper front of a body, a back area worn on a back of the body, and a hip-waist area worn in a hip or waist area of the body;
- the coverall having an interior surface for facing the body harness when worn by the person over the body harness and the coverall having an exterior surface for facing an exterior environment; the coverall further having a front side and a back side;
- the coverall further having a body portion for covering a person's torso when the coverall is worn by the person; the body portion having at least one torso opening for donning the coverall and a neck opening for a person's head and neck;
  - the body portion having a plurality of openings for a person's limbs, including a first opening ending in a first sleeve for receiving a portion of a person's right arm when the person wears the coverall, and a second opening ending in a second sleeve for receiving a portion of a person's left arm when the person wears the coverall, with each of the sleeves further having an opening for a person's wrist and hand;
  - the body portion also having a third opening ending in a first pant sleeve for receiving a portion of a person's right leg when the person wears the coverall, and a fourth opening ending in a second pant sleeve for receiving a portion of a person's left leg when the person wears the coverall, with each of the pant sleeves further having an opening for a person's ankle and foot;
- wherein the body portion additionally has a plurality of safety ring openings, with each safety ring opening provided with a safety ring sleeve for receiving a safety ring attached to the body harness, each safety ring sleeve further ending in an elasticized cuff.

This invention also relates to protective coverall suitable for use over a body harness worn by a person to support that person with safety lines or ropes attached to that body harness during an activity or if the person should fall,

- with the body harness having a plurality of safety rings suitable for attaching the body harness to a plurality of lines or ropes, the body harness having an upper front area worn on an upper front of a body, a back area worn on a back of the body, and a hip-waist area worn in a hip or waist area of the body;
- the coverall having an interior surface for facing the body harness when worn by the person over the body harness and the coverall having an exterior surface for facing an exterior environment;
- the coverall further having a body portion for covering a person's torso when the coverall is worn by the person;

the body portion having at least one torso opening for donning the coverall and a neck opening for a person's head and neck;

the body portion having a plurality of openings for a person's limbs, including a first opening ending in a first sleeve for receiving a portion of a person's right arm when the person wears the coverall, and a second opening ending in a second sleeve for receiving a portion of a person's left arm when the person wears the coverall, with each of the sleeves further having an opening for a person's wrist and hand;

the body portion also having a third opening ending in a first pant sleeve for receiving a portion of a person's right leg when the person wears the coverall, and a fourth opening ending in a second pant sleeve for receiving a portion of a person's left leg when the person wears the coverall, with each of the pant sleeves further having an opening for a person's ankle and foot;

wherein the body portion additionally has a plurality of safety ring openings with each safety ring opening provided with a safety ring sleeve for receiving a safety ring attached to the body harness, each safety ring sleeve further ending in an elasticized cuff;

wherein the plurality of safety ring openings includes i) a back ring opening with back safety ring sleeve for receiving a back safety ring attached to the back area of the body harness, ii) a front ring opening with first front safety ring sleeve for receiving a front safety ring attached to the upper front area of the body harness, iii) a first hip-waist safety ring opening with a first hip or waist safety ring sleeve for receiving a first hip or waist safety ring attached to the hip or waist area of the body harness, and iv) a second hip-waist safety ring opening with a second hip or waist safety ring sleeve for receiving a second hip or waist safety ring attached to the hip or waist area of the body harness;

wherein the first and second hip-waist safety ring openings and the first and second hip or waist safety ring sleeves are symmetrically positioned on the body portion in a hip or waist area of the coverall.

DETAILED DESCRIPTION OF THE INVENTION

This invention relates to a protective coverall suitable for use over a body harness worn by a person to support that person with safety lines or ropes attached to that body harness during an activity, or if the person should fall. The coverall is suitable for use with a body harness having a plurality of safety rings suitable for attaching the body harness to a plurality of lines or ropes. The body harness typically has an upper front area worn on an upper front of the body, a back area worn on a back of the body, and a hip-waist area worn in a hip or waist area of the body.

By "body harness" it is preferably meant what is known in the art as a full body harness formed from a series of straps or other restraints that encircle or partially encircle the torso of a body and can extend down the thighs. Generally, this type of harness has some combination of over-the-shoulder, chest, back, and waist straps attached by various buckles for securing the harness in place on the torso. The body harness additionally has a plurality of safety rings attached to, or available to, the outside surface of the body harness for attachment to a line or rope. Some exemplary types of body harnesses are shown in FIGS. 5 to 9.

Figure 5:
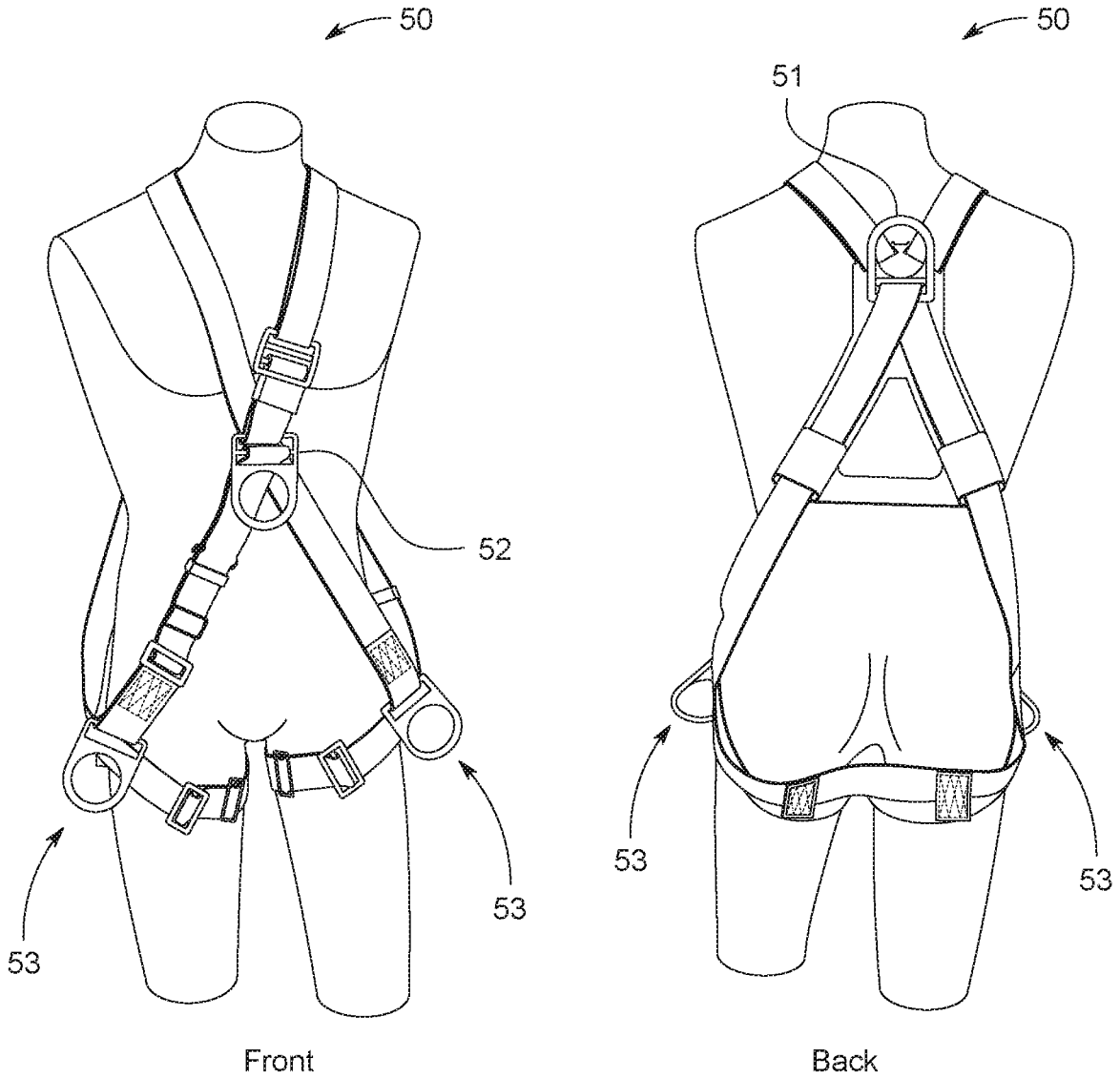
FIG. 5 is a photo showing front and back views of a body harness having four safety rings, with one safety ring in the upper back, one safety ring in the upper front, and two opposing safety rings symmetrically distributed at the waist-hips.

FIG. 5 is a photo of a four-point body harness 50 on a mannequin; that is, a body harness having four safety rings, with one safety ring 51 in the upper back, one safety ring 52 in the upper front, and two opposing safety rings 53 symmetrically distributed at the waist, essentially on either hip.

As used herein, the areas of "upper back" and "upper front", in regard to the location of features of the body harness or the protective coverall, are preferably meant to include or cover an area of either the back or the front, respectively, of the torso or body portion that has a lower horizontal boundary that is approximately the center of the torso or body portion and extends upward to the tops of the shoulders as the upper horizontal boundary. Additionally, as used herein, features at the "tops of the shoulders" are considered to be part of the upper front of either the body harness or protective coverall. Additionally, for the purposes herein, the lower horizontal boundary of the upper front or upper back includes the horizontal center of the front or back of the torso or body portion. The "upper back" and "upper front" are preferably vertically bounded at the sides of the coverall where the back of the coverall meets the front of the coverall under the arms, and preferably this meeting point is a vertical line drawn through the center of the arm sleeve on each side of the body portion.

The area referred to herein as "hip-waist" area is considered to be either the hip area or waist area, or both, of the body harness or protective coverall. Additionally, the "hip-waist area" in regard to the location of features of the body harness or the protective coverall is preferably meant to include the torso or body portion (in either the front, back, or sides of the body harness or protective coverall) that has a upper horizontal boundary that is approximately the center of the torso or body portion and extends downward to at least the tops of the legs or the pants sleeves of the coverall, and this hip-waist area may include areas including a part of the thighs or the upper part of the pants sleeves covering the thighs. Additionally, for the purposes herein, the upper horizontal boundary of the hip-waist area excludes the horizontal center of the front, back, or sides of the torso or body portion. "Hip rings" from the body harness can additionally be positioned on the sides of the torso or body portion at waist level, hip level, or even a bit lower on the thighs.

Figure 1:
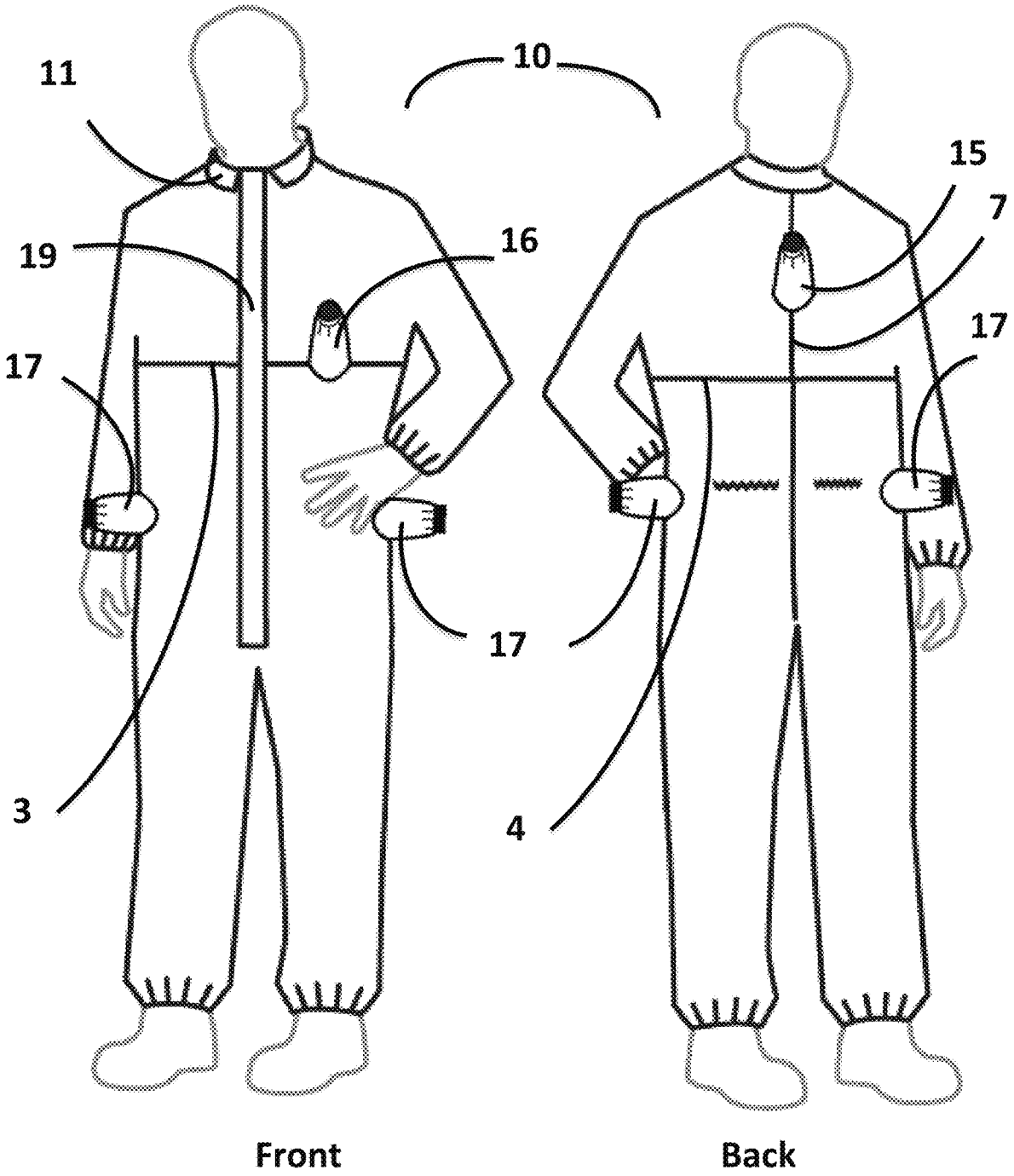
FIG. 1 is an illustration of front and back views of one embodiment of protective coverall having a collar neck opening and a plurality of safety ring sleeves, with each safety ring sleeve further having an elasticized cuff. This particular embodiment has a total of four safety ring sleeves (as shown in several figures, safety ring sleeves (and openings) on the sides of the coverall may be viewable on both the front and back views).

As used herein, features on the coverall are considered vertically oriented if they are parallel to a vertical line drawn generally from head to toe while the coverall is worn by a standing person. Features on the coverall are considered horizontally oriented if they are perpendicular to that vertical line. That is, the orientations "vertical" and "horizontal" as used herein, refer to the coverall as viewed when worn by a standing person as shown in FIG. 1. The line 7 is a seam that is considered vertically oriented and lines 3 and 4 are seams that are considered horizontally oriented. The body portion of the coverall is preferably longer in the vertical direction and shorter in the horizontal direction, and therefore the body portion of the coverall preferably has a longer vertical dimension and a shorter horizontal dimension.

Figure 6:
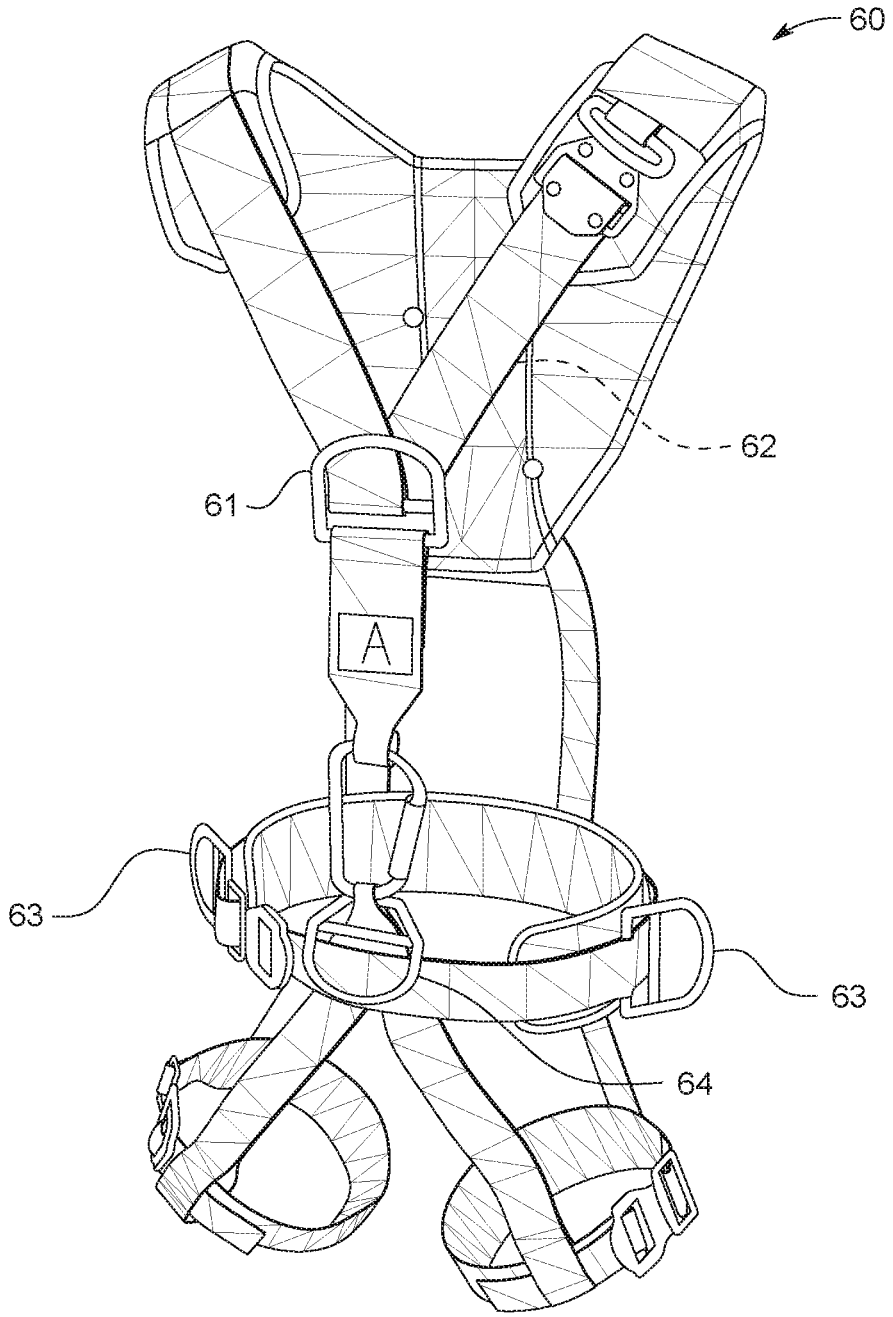
FIG. 6 is an illustration of a front view of one embodiment of one type of body harness having a safety ring in the upper front area of the harness, a safety ring in the upper back of the harness (not clearly shown, but attachment rivets are visible from this view), two opposing hip safety rings at the hip-waist of the harness, and one center front waist safety ring between the two opposing hip safety rings.

FIG. 6 is a front view of a version of a five-point body harness 60, having a safety ring 61 in the upper front area of the harness, a safety ring 62 in the upper back of the harness (not clearly shown, but attachment rivets are visible from this view), two opposing hip safety rings 63 at the hip-waist of the harness, and one center front waist safety ring 64 between the two opposing hip safety rings. The center front waist safety ring is shown positioned slightly higher on the torso than the two hip safety rings; however, the ring could be positioned at the same level, essentially on the strap connecting the two hip rings.

Figure 7:
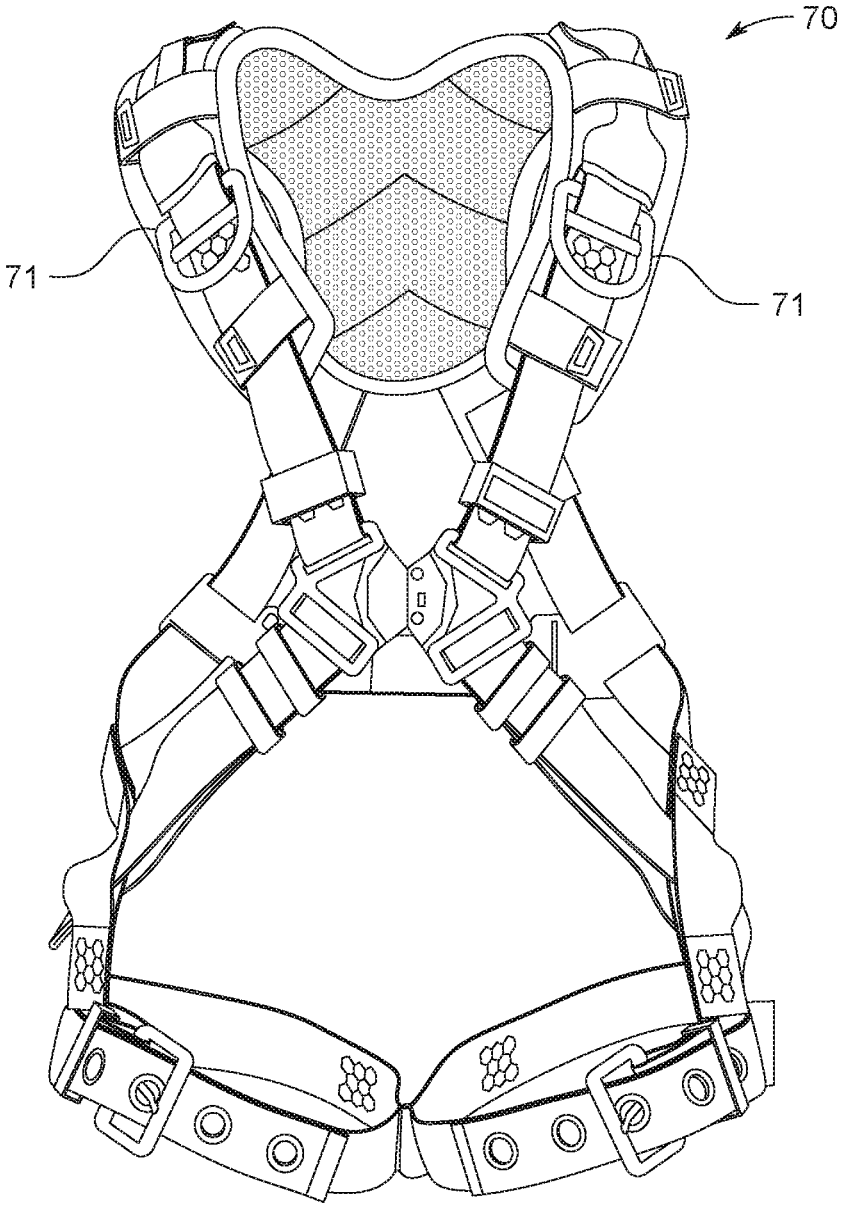
FIG. 7 is a photo of a front view of one embodiment of one type of body harness having a two safety rings symmetrically distributed in the upper front area of the harness and a safety ring in the upper back area of the harness that is not shown in this view.

FIG. 7 is a front view of a version of a three-point body harness 70 having a two safety rings 71 symmetrically distributed in the upper front area of the harness and one safety ring that is not shown by this view at the center of the upper back.

Figure 8:
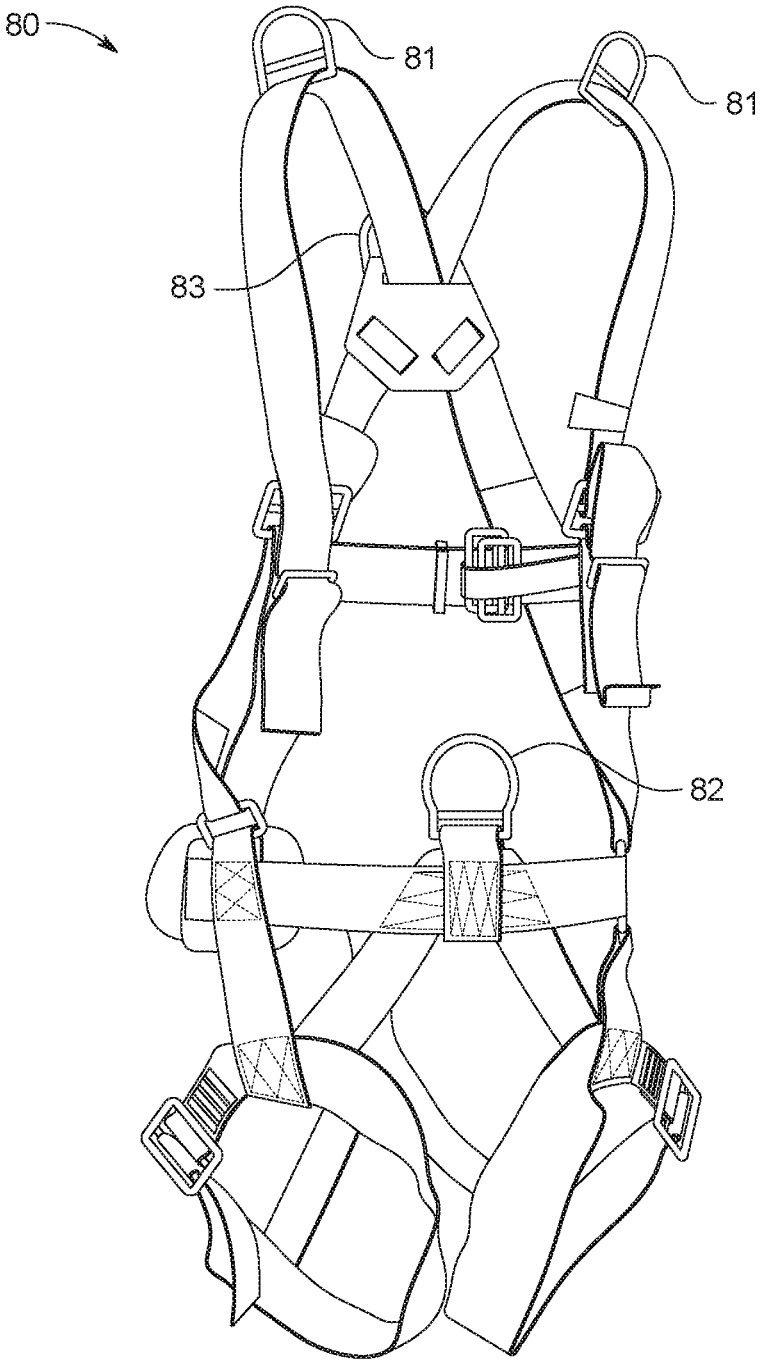
FIG. 8 is a photo of a front view of one embodiment of one type of body harness that is generally suitable for use as a vertical extraction harness or in confined spaces, having a two safety rings symmetrically distributed on the straps at the tops of the shoulders. The harness has, in addition, a third safety ring at the center waist area of the front, and a fourth safety ring at the upper back of the harness that is partially obscured by the harness straps.

FIG. 8 is a front view of another version of a four-point body harness 80 that is generally suitable for use as a vertical extraction harness or in confined spaces. This body harness has a two safety rings 81 symmetrically distributed at the tops of the shoulders. Therefore, as defined herein, these two safety rings are considered to be part of the upper front of the harness and coverall. The harness has, in addition, a third safety ring 82 at the center waist area of the front, and a fourth safety ring 83 at the center upper back of the harness (partially obscured by the harness straps).

Figure 9:
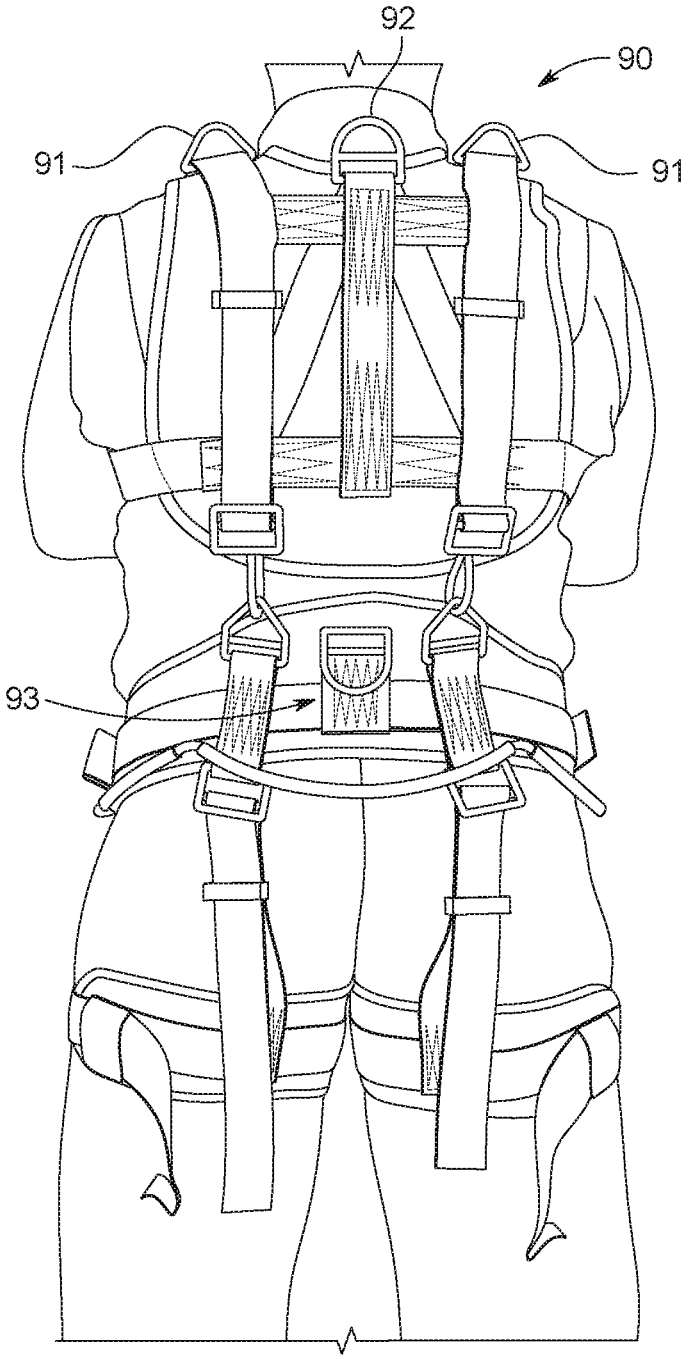
FIG. 9 is a photo of the back view of another embodiment of one type of body harness generally suitable for use as a vertical extraction harness or in confined spaces, having a two safety rings symmetrically distributed on straps at the tops of the shoulders, and a third safety ring positioned between those two rings at the upper back. The harness has, in addition, a third safety ring at the center waist area of the back.

FIG. 9 is a back view of a person wearing another embodiment of multipoint body harness 90 generally suitable for use as a vertical extraction harness or in confined spaces, having a two safety rings 91 symmetrically distributed at the top of the shoulders, and a third safety ring 92 positioned between those two rings at the upper back. The harness has, in addition, a third safety ring 93 at the center waist area of the back.

While only a few body harnesses and safety ring positions are shown and described herein, it is understood that body harnesses can be of many different types with many different arrangements of safety rings. Further, it is understood that all of the safety rings on a harness may not be used at the same time. For example, a 5-point harness may be used as a four-point harness if one of the safety rings is not attached to a line or rope.

Figure 4A:
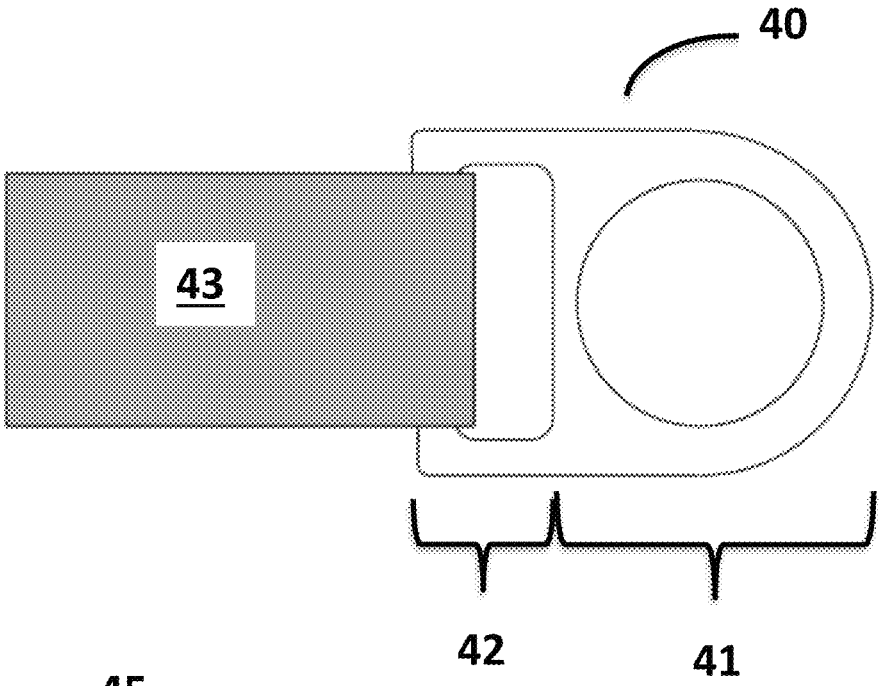
FIG. 4A is an illustration of one embodiment of one type of safety ring having a ring attachment section and an attachment shank, shown attached to a strap from a safety harness (harness not shown).

As used herein, a safety ring is a part having a ring attachment section suitable for attaching the part to a line or safety rope, and an attachment shank for securing the part to a body harness. Typically, safety rings are made from durable material such as metal. The most common type of safety ring is called a D-ring because it has a D-like shape, although other types of ring shape are possible. FIG. 4A includes an illustration of a D-ring safety ring. The safety ring 40 has a ring attachment section 41 and an attachment shank 42. As shown in the figure, the attachment shank of the safety ring is attached to a strap 43 from a safety harness (harness not shown). It is understood that although the safety ring attachment section shown in the figure is circular, the ring attachment section could have other shapes. Likewise, other types of attachment shanks are possible.

The coverall has an interior surface for facing the body harness when worn by the person over the body harness; and the coverall has an exterior surface for facing an exterior environment. The coverall further has a front side associated with covering the front of a person's body (and/or the front side of the body harness) and a back side associated with covering the back of a person's body (and/or the back side of the body harness).

The coverall has a body portion for covering a person's torso when the coverall is worn by a person; the body portion having at least one torso opening for donning the coverall and a neck opening for a person's head and neck. The at least one torso opening and neck opening may be connected when the at least one torso opening is not closed. The body portion further has a plurality of openings for a person's limbs, including a first opening ending in a first sleeve for receiving a portion of a person's right arm when the person wears the coverall, and a second opening ending in a second sleeve for receiving a portion of a person's left arm when the person wears the coverall, with each of the sleeves further having an opening for a person's wrist and hand. The body portion also has a third opening ending in a first pant sleeve for receiving a portion of a person's right leg when the person wears the coverall, and a fourth opening ending in a second pant sleeve for receiving a portion of a person's left leg when the person wears the coverall, with each of the pant sleeves further having an opening for a person's ankle and foot.

The body portion of the coverall additionally has a plurality of safety ring openings with each safety ring opening provided with a safety ring sleeve for receiving a safety ring attached to the body harness, with each safety ring sleeve further ending in an elasticized cuff. Each elasticized cuff has a size compatible with the size of the safety ring received in the safety ring sleeve, such that the elasticized cuff can expand to allow the safety ring to extend through the cuff, or partially extend through the cuff, to the exterior environment of the coverall and the elasticized cuff holds the safety ring in that position. Preferably the safety ring is held by the elasticized cuff so that the entire ring attachment section is exterior to the coverall and available for attachment to a line or safety rope, while the safety ring attachment shank remains interior to the coverall, with the safety ring sleeve covering and protecting the harness strap (s) that attach the safety ring to the harness.

In some embodiments, the body portion of the coverall has a plurality of safety ring openings, with each safety ring opening provided with a safety ring sleeve for receiving a safety ring attached to the body harness, that includes a back ring opening with back safety ring sleeve for receiving a back safety ring attached to the back area of the body harness, and a first front ring opening with first front safety ring sleeve for receiving a front safety ring attached to the upper front area of the body harness.

In some embodiments, the body portion of the coverall has a plurality of safety ring openings with each safety ring opening provided with a safety ring sleeve for receiving a safety ring attached to the body harness, and includes a first hip-waist (hip or waist) safety ring opening for a first hip or waist safety ring sleeve for receiving a first hip or waist safety ring attached to the hip-waist area of the body harness, and optionally, a second hip-waist safety ring opening for a second hip or waist safety ring sleeve for receiving a second hip or waist safety ring attached to the hip-waist area of the body harness.

FIG. 1 is an illustration of front and back views of one embodiment of protective coverall 10 having a collar neck opening 11 and a plurality of safety ring sleeves, with each safety ring sleeve further having an elasticized cuff as shown by the darkened area of the sleeve. This particular embodiment has a total of four safety ring sleeves, including a back safety ring sleeve 15, a first front safety ring sleeve 16, and first and second hip or waist safety ring sleeves 17. As shown in this figure and other figures, the safety ring sleeves are drawn with a vertical or horizontal orientation with regards to the coverall while being worn. It is understood that these sleeves are not meant to be shown as rigid sleeves and are only shown this way to illustrate their extended state when they are typically used with an associated safety ring attached to a line or rope. For example, in FIG. 1, first front safety ring sleeve 16 is normally oriented vertical with the coverall with the cuff being up, because a line attached to a safety ring in the sleeve is normally attached to a point above the wearer's body. Likewise, the first and second hip or waist safety ring sleeves 17 are normally oriented horizontal to the coverall with the cuff extending to the sides, because each line attached to a safety ring in these sleeves is normally attached to a point on an opposing side of the wearer's body. In practice, when not used with a safety ring, each sleeve will collapse or fall by gravity as the stiffness of the fabric allows.

The coverall can have seams where the protective fabric is sewn together to create the coverall, the protective fabric having been cut into shapes that are advantageous to manufacturing of the coverall. For example, FIG. 1 illustrates by the solid horizontal lines 3 & 4 a preferred horizontal seam traversing across the front of the coverall, and a preferred horizontal seam traversing across the back of the coverall, respectively. The vertical position of these horizontal seams can move upward or downward on the body portion of the coverall, either closer or further away from the waistline of the coverall, depending on the size of the coverall. Preferably, however, these horizontal seams are positioned on the upper front and upper back of the coverall. FIG. 1 also illustrates, by the solid vertical line 7, a preferred vertical seam on the back of the coverall extending from the neckline down to the crotch of the coverall. Preferably this vertical seam is positioned on the centerline of the coverall on the body portion.

Figure 2:
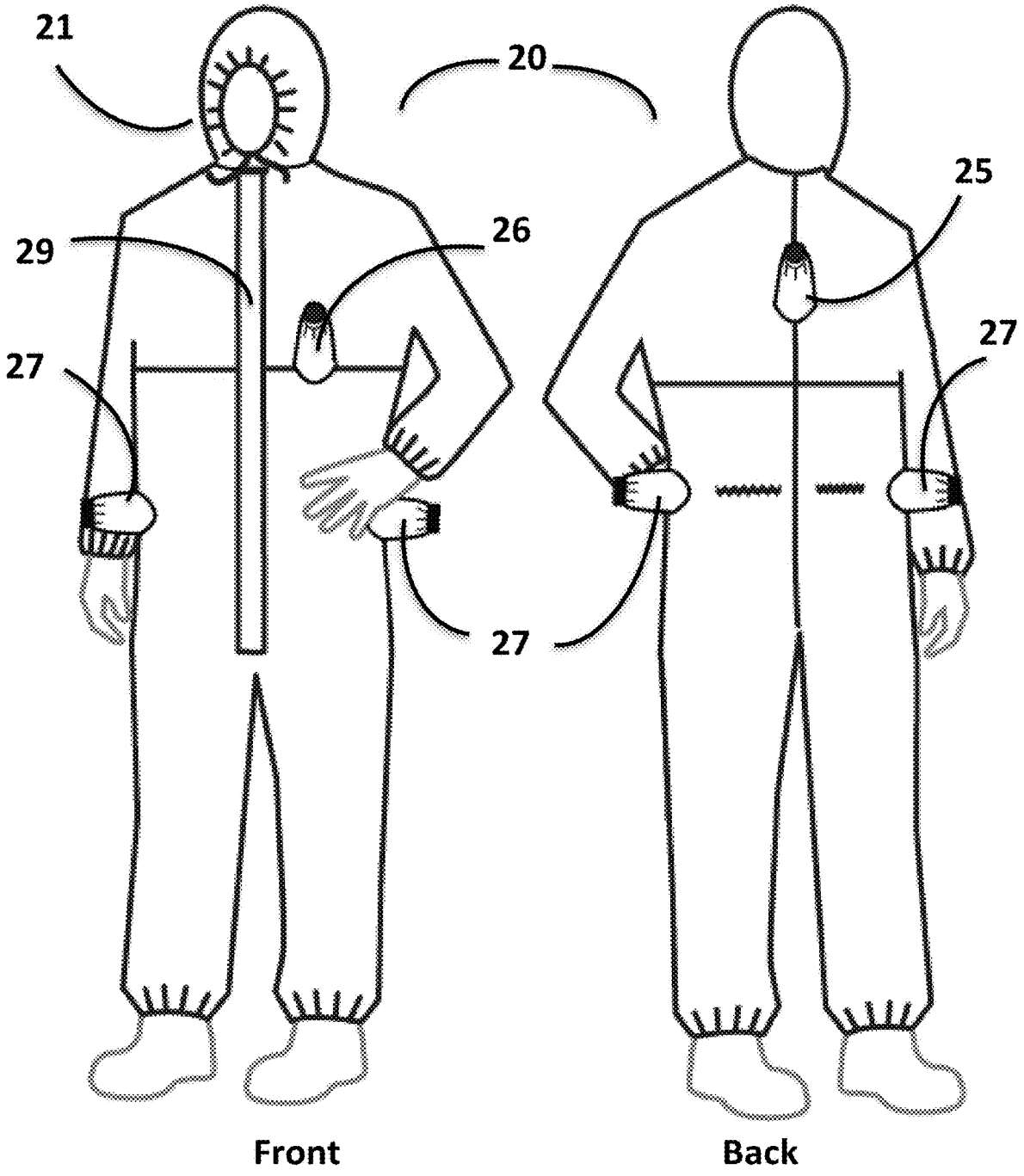
FIG. 2 is an illustration of front and back views of one embodiment of protective coverall having a hooded neck opening and a plurality of safety ring sleeves, with each safety ring sleeve further having an elasticized cuff. This particular embodiment has a total of four safety ring sleeves.

In some embodiments, the neck opening of the body portion of the protective coverall ends in a hood for the head. FIG. 2 is an illustration of front and back views of one embodiment of protective coverall 20 having a hooded neck opening 21 and a plurality of safety ring sleeves, with each safety ring sleeve further having an elasticized cuff as shown by the darkened area of the sleeve. This particular embodiment has a total of four safety ring sleeves, including a back safety ring sleeve 25, a first front safety ring sleeve 26, and first and second hip or waist safety ring sleeves 27.

As shown in FIGS. 1 & 2, if both the first and second hip or waist safety ring openings are present in the protective coverall, they and their associated safety ring sleeves can be symmetrically positioned in a hip or waist area of the coverall, such as shown with a safety ring sleeves on opposing hips.

Preferably, the body portion of the protective coverall has at least one safety ring opening that has a circular, round, or rounded shape. In some embodiments, the rounded shape safety ring opening has a major dimension or diameter of about 6.5 to 15 inches. In some other embodiments the rounded shape safety ring opening has a major dimension or diameter of about 6.5 to 9 inches.

In some preferred embodiments, the body portion of the protective coverall has at least one safety ring opening that has an oval shape. It is believed an oval-shaped safety ring opening is a preferred method of accommodating the varying location of the safety rings on different body harnesses.

In some embodiments, the at least one oval-shaped safety ring opening in the body portion has a long dimension having a length and a perpendicular short dimension having a width, and preferably the short dimension width is at least 1.0 inches (2.54 cm) wider than the diameter of the safety ring that will be used with the coverall (the diameter of the safety ring being the nominal width of the safety ring perpendicular to the long dimension of the safety ring that is not the thickness of the safety ring). In some embodiments, the oval-shaped safety ring opening has a long dimension length of about 6.5 to 15 inches. This oval-shaped safety ring opening can further have in some embodiments a perpendicular short dimension length of 3.5 to 9 inches. In some other embodiments the oval-shaped safety ring shape opening has a long dimension length of about 6.5 to 9 inches. The oval-shaped safety ring opening can further have in some embodiments a perpendicular short dimension length of 3.5 to 6 inches.

Figure 3A:
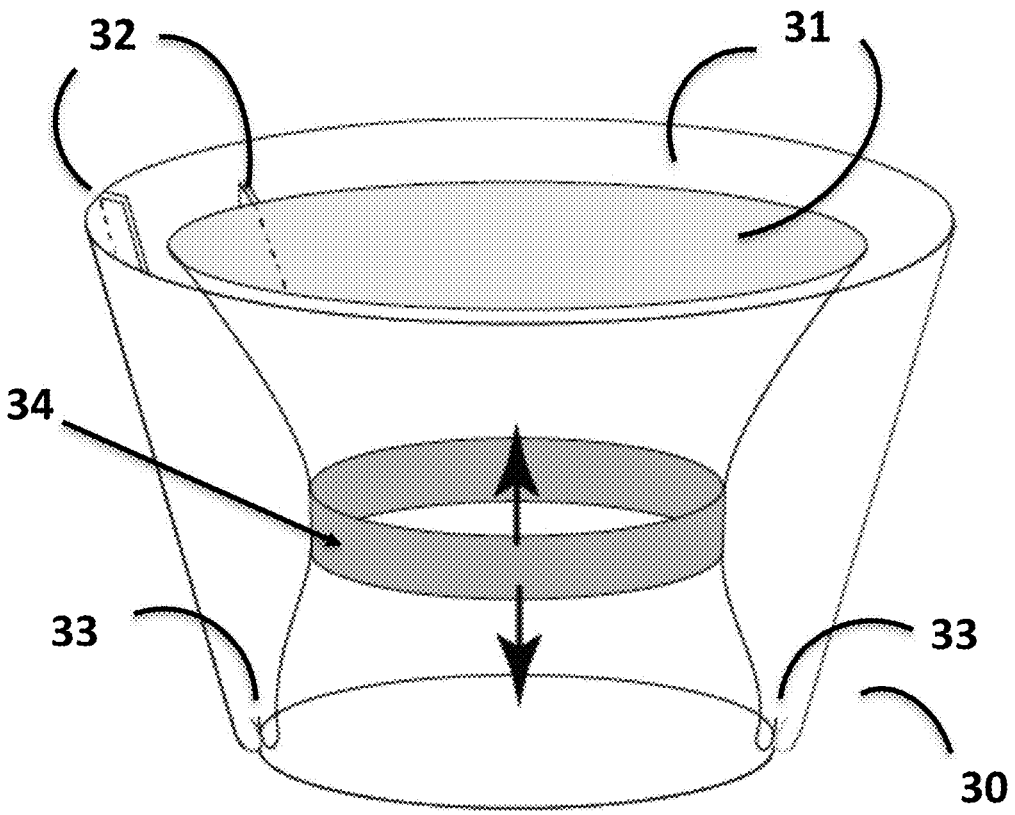
FIGS. 3A & 3B are illustrations of the assembly and general appearance, respectively, of one embodiment of a conical or cone-shaped safety ring sleeve comprising two sleeve plies, and an elasticized cuff comprising an elastic band encapsulated by the two sleeve plies, wherein the widest opening of the conical sleeve is intended to be attached to the coverall body portion at the safety ring opening, and narrowest opening of the conical sleeve being the elasticized cuff.
Figure 3B:
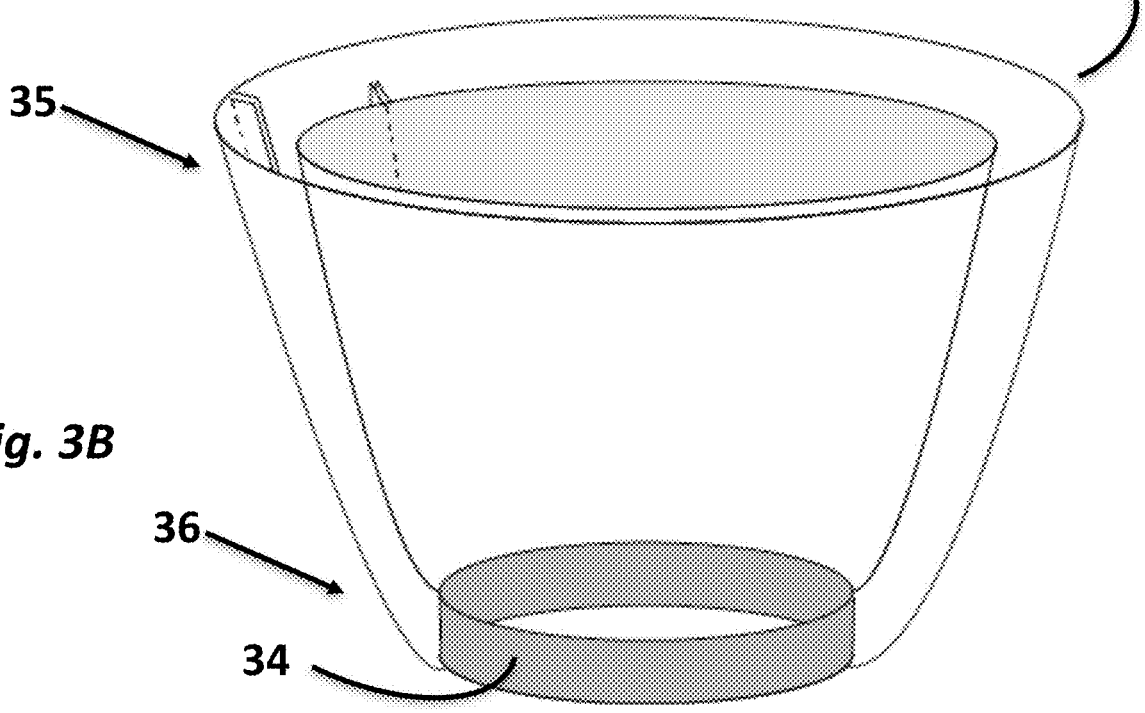

Preferably, the protective coverall has at least one safety ring sleeve that is conical or cone-shaped with the widest opening of the sleeve being at the safety ring opening in the body portion and narrowest opening of the sleeve being the elasticized cuff. The at least one safety ring sleeve in the protective coverall can comprise two sleeve plies that are sewn together, and the elasticized cuff can comprise a free-floating elastic band encapsulated by the two sleeve plies. FIGS. 3A & 3B are illustrations of the assembly and general appearance, respectively, of a preferred embodiment of a conical or cone-shaped safety ring sleeve comprising two sleeve plies and an elasticized cuff comprising an elastic band encapsulated by the two sleeve plies, wherein the widest opening of the conical sleeve is intended to be attached to the coverall body portion at the safety ring opening, and the narrowest opening of the conical sleeve being the elasticized cuff. As shown in FIGS. 3A & 3B, the two-ply hollow sleeve 30 can for example be made by first making two separate hollow cones out of single-ply material 31 by cutting generally curved trapezoidal-shaped layers; that is, two of the four sides are curved in the same direction while the other two sides are the same length, and attaching the two sides having the same length together, for example by sewing or ultrasonic welding or another method, to form a seam 32 to form cones. The narrow ends of the cones are subsequent hemmed or welded together, followed by turning the sleeve inside out to hide the hemmed or welded seam 33 inside the two-ply cone. An elastic band 34 is slid over the inner ply and pushed to the narrow end 36 of the cone. Preferably, the elastic is not further sewn into the sleeve to allow it to freely float between the plies of material. The two-plied larger ends 35 of the conical sleeve can then either be attached together, for example by sewing or some other method like ultrasonic welding or taping to form the hollow sleeve, and then further attached (again for example by sewing or another method) to the body portion edges at the safety ring opening; or the two plied larger end of the conical sleeve can be attached (again for example by sewing or other method) directly to the body portion edges of the coverall at the safety ring opening in one step.

In an alternative embodiment, the at least one safety ring sleeve comprises one single ply of the protective fabric, or multiple plies of the protective fabric sewn together, wherein elastic band is attached to the plies to form the elasticized cuff. The elastic band can be attached by many different methods, but attaching the elastic band to the protective fabric by stitching is a preferred method. One preferred such method is to attach the elastic to the edge of the sleeve by use of an overedge stitch, preferably with the elastic positioned on the interior surface of the safety ring sleeve. Alternatively, the elasticized cuff can be made by fully covering or encapsulating both sides of the elastic with the protective fabric and then stitching, which would then keep the elastic attached to the safety ring sleeve. For example, the elastic of the freely floating cuff described in FIGS. 3A & 3B could be additionally stitched to the sleeve fabric if desired to prevent the elastic from moving in the cuff.

Figure 4B:
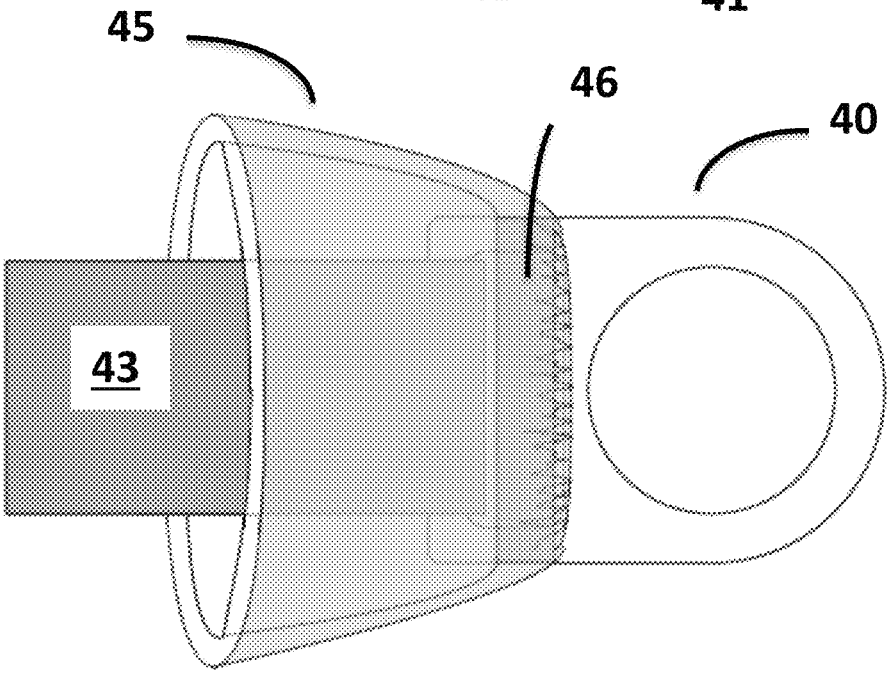
FIG. 4B is an illustration of one embodiment of the combination of the safety ring and the safety ring sleeve ending with an elasticized cuff; the elasticized cuff has a size compatible with the safety ring such that the elasticized cuff can expand to allow the safety ring to extend through the cuff, or partially extend through the cuff, such that the ring attachment section of the safety ring is in the exterior environment of the coverall, and the cuff holds the safety ring by the attachment shank, covering and protecting the attachment strap to the safety harness from the exterior environment.

FIG. 4B is an illustration of one embodiment of the combination of the safety ring 40 and the safety ring sleeve 45 ending with an elasticized cuff 46, showing the ring attachment section of the safety ring has fully passed through the sleeve to the exterior of the coverall, so that the ring attachment section is accessible to any lines or ropes to be attached to the ring. The elasticized cuff of the ring sleeve holds the safety ring by the attachment shank, covering and protecting the attachment strap 43 to the body harness from the exterior environment.

The elastic band in the elasticized cuff has a size (generally an inner relaxed circumference) that is compatible with the size of the safety ring received in the safety ring sleeve, such that the relaxed elasticized cuff can expand to allow the safety ring to extend through the cuff, or partially extend through the cuff, to the exterior environment of the coverall and hold the safety ring in that position. The elastic band may be purchased as a continuous circular band (like an elastomeric band) or may be fabricated by sewing (or joining) a length of an elastic strip to create a continuous circular elastic band.

In some embodiments, the elasticized cuff comprising the elastic band has a relaxed circumference of about 3 to 5 inches, meaning the relaxed circular cuff has a diameter of about 0.95 to 1.60 inches. As used herein, the word "relaxed" means the elasticized cuff comprising the elastic band is unstretched or untensioned, the elastic band in the cuff being unstretched or untensioned or generally present without any retracting force. It is believed this relaxed elasticized cuff circumference, when stretched to accommodate the width of the safety ring, is adequate to grip and hold the attachment shank of typical safety rings, preferably safety rings having attachment shanks with a circumference of about 4 to 9 inches. Such safety rings can include those with the attachment shanks have a nominal thickness of about 0.125 inches with the attachment shanks having a nominal width perpendicular to the long dimension of the safety ring of about 2.25 inches to 4.0 inches wide. This means many typical attachment shanks can range from a generally rectangular circumference of about 4.75 (i.e., 2.25+0.125+0.125+2.25) to about 8.25 inches or a little more or less.

The relaxed size and elasticity (the stretch and retraction) of the elasticized cuff comprising the elastic band preferably allows the elasticized cuff at the exterior sleeve opening to fit and hold in place safety rings having attachment shanks that are at least 15% larger in circumference than the relaxed elasticized cuff circumference. Such elasticized cuffs are further believed to suitable for holding in place safety rings having attachment shanks that are as large as 110% larger in circumference (i.e., over twice the relaxed elasticized cuff circumference) than the relaxed circumference of the elasticized cuff.

The two-ply hollow sleeve is a preferred embodiment because it has been found that the two-ply sleeve unexpectantly helps block the sleeve opening if the sleeve is not used with a safety ring. It is believed the extra layer of fabric on the inside crumples inside the sleeve if the sleeve is not used and helps prevent a significant amount of particulates and other matter from passing through the sleeve.

In some embodiments, the sleeve (with elasticized cuff) has an overall length of about 5.75 to 16 inches, the length being measured parallel to the centerline of the hollow sleeve; that is, the sleeve (with elasticized cuff) can extend 5.75 to 16 inches perpendicularly from the outside surface of the body portion of the coverall. In some preferred embodiments, the sleeve (with elasticized cuff) has an overall length of about 5.75 to 12 inches, the length measured parallel to the centerline of the hollow sleeve; that is, the sleeve (with elasticized cuff) can extend 5.75 to 12 inches perpendicularly from the outside surface of the body portion of the coverall. In some more preferred embodiments, the sleeve (with elasticized cuff) has an overall length of about 5.75 to 9 inches, the length measured parallel to the centerline of the hollow sleeve; that is, the sleeve (with elasticized cuff) can extend 5.75 to 9 inches perpendicularly from the outside surface of the body portion of the coverall.

Figure 10:
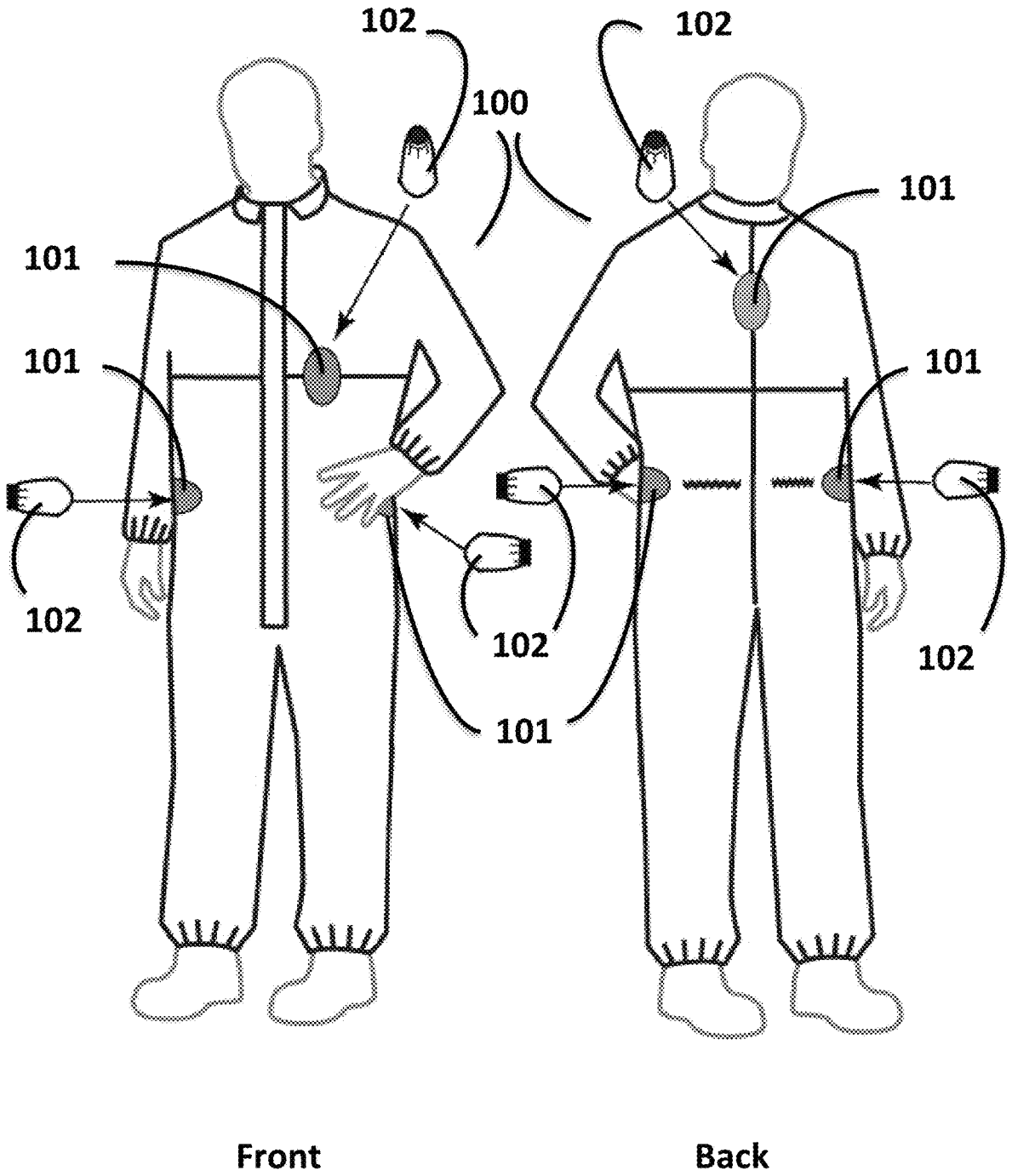
FIGS. 10 & 11 are illustrations of front and back expanded or assembly views of protective coverall embodiments, the coverall having a collar neck opening and a hooded neck opening, respectively, showing a total of four oval-shaped safety ring openings and the attachment of the widest opening of each conical safety ring sleeve to those safety ring openings; each safety ring sleeve further ends in an elasticized cuff.

The safety ring sleeves can be attached to the coverall by sewing, or otherwise attached by a suitable method, with each sleeve attached to the coverall material surrounding each safety ring opening. For example, FIG. 10 is an illustration of front and back expanded views of one embodiment of protective coverall 100 having a collar neck opening, further showing a total of four oval-shaped safety ring openings 101 and the attachment of the widest opening of each conical safety ring sleeve 102 to those safety ring openings; each safety ring sleeve further ends in an elasticized cuff. Likewise, FIG. 11 is an illustration of front and back expanded views of one embodiment of protective coverall 110 having a hooded neck opening, further showing a total of four oval-shaped safety ring openings 111 and the attachment of the widest opening of each conical safety ring sleeve 112 to those safety ring openings; each safety ring sleeve further ends in an elasticized cuff.

Figure 11:
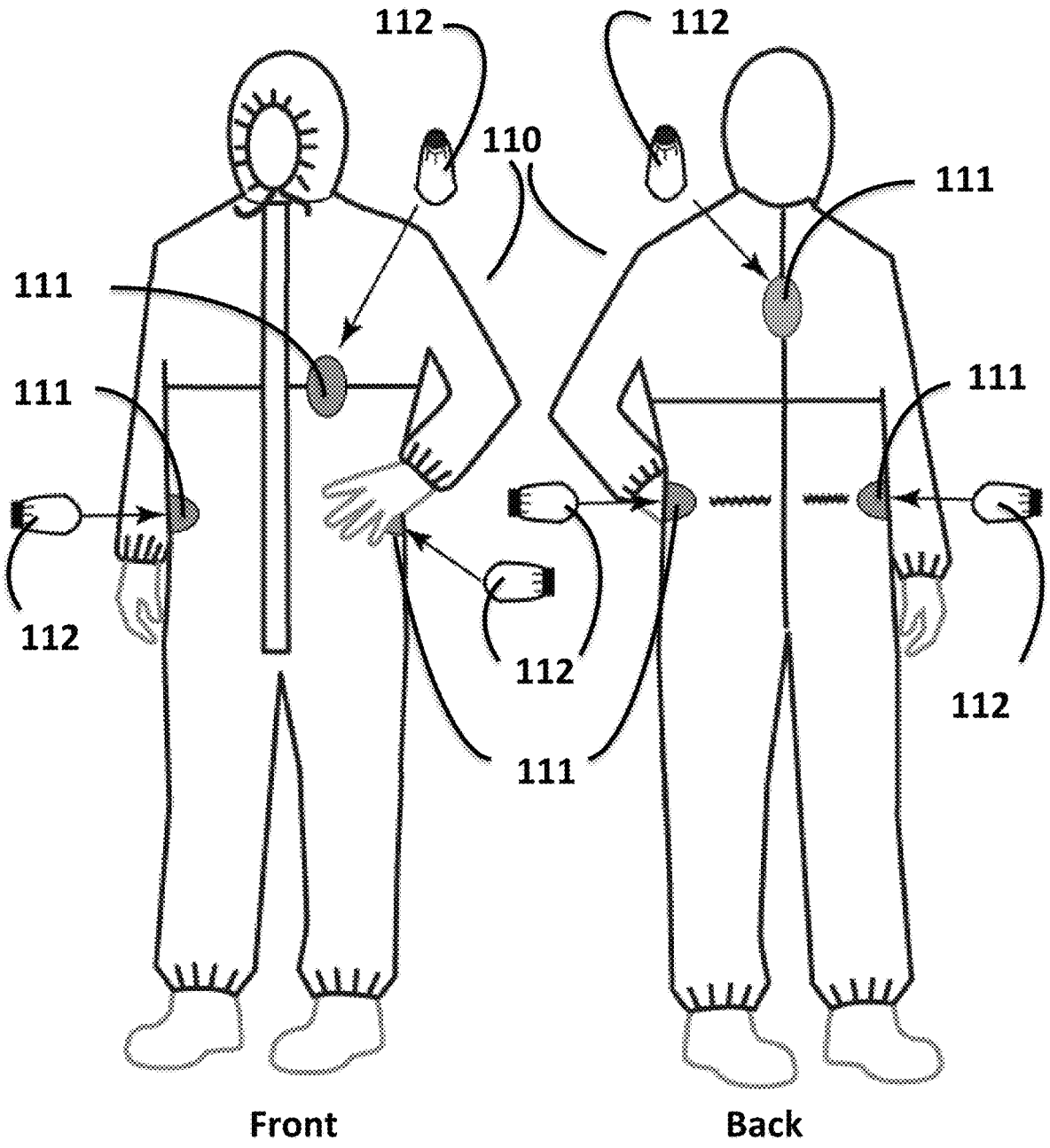

As shown in FIGS. 10 & 11, if the body portion of the coverall has an oval-shaped safety ring opening, the long axis of the oval can be oriented either vertically or horizontally in the coverall. Preferably the long axis of any oval-shaped opening is oriented parallel to the likely movement of the safety ring while attached to an exterior line. For example, in FIGS. 10 & 11, the ring openings in the upper chest and the upper back have oval-shaped safety ring openings wherein the long axis of the oval is vertically oriented. These rings are normally attached to lines that are further desirably attached to an external point above the wearer so that the wearer's center of mass is supported or to assist vertical movement. Likewise, the ring openings at the hips are oval-shaped safety ring openings wherein the long axis of the oval is horizontally oriented. These rings are normally attached to lines that are further attached to points on each side of the wearer to assist desirable movement of the wearer from side-to-side; or alternatively, stabilize the wearer and limit undesirable side-to-side movement.

Figure 12A:
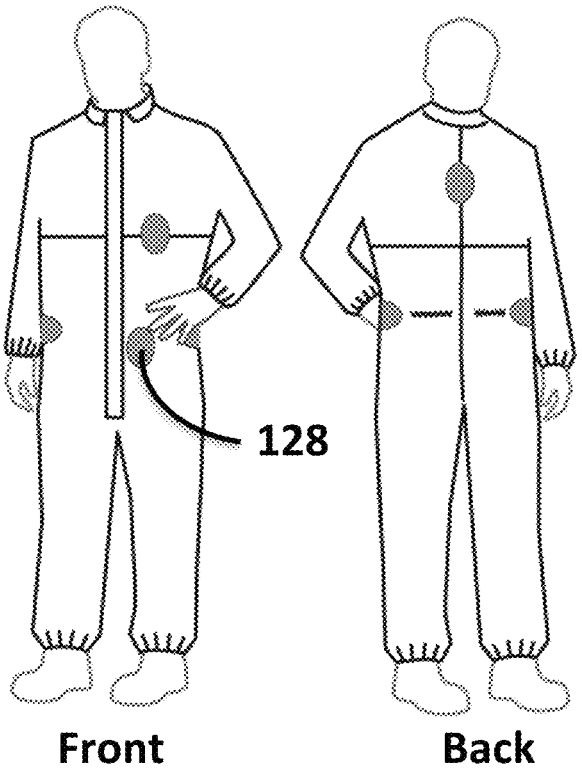
FIGS. 12A & 13A are illustrations of the orientations of five oval-shaped safety ring openings of front and back views of a protective coverall having a collar neck opening and a hooded neck opening, respectively.
Figure 12B:
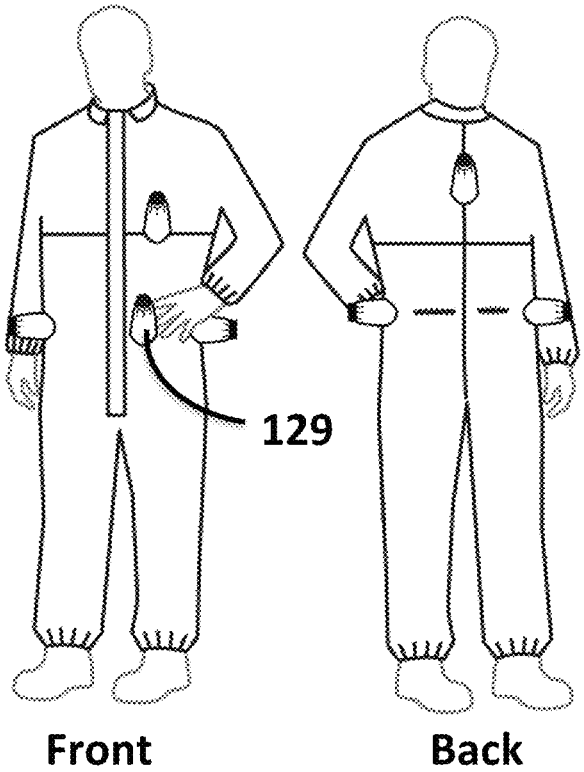
FIGS. 12B & 13B are illustrations of front and back views of embodiments of a protective coverall having a collar neck opening and a hooded neck opening, respectively, wherein each of the five oval-shaped safety ring openings of FIGS. 12A & 13A is provided with a safety ring sleeve having an elasticized cuff.
Figure 13A:
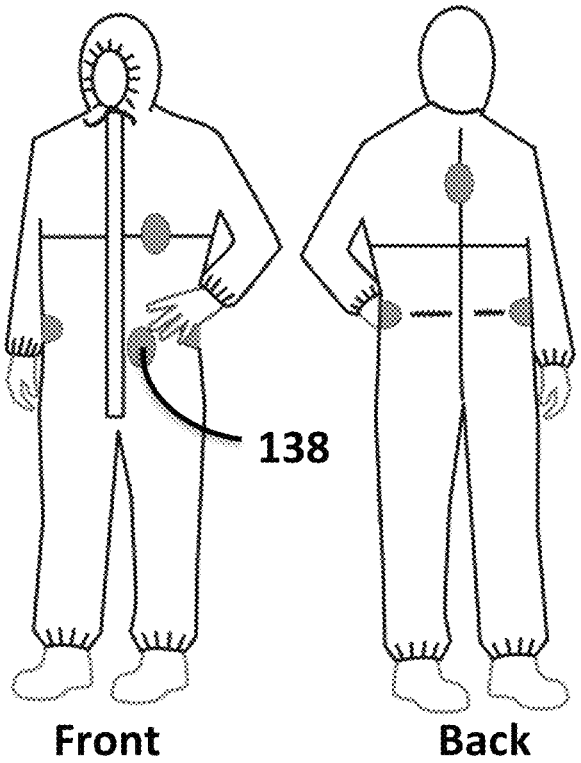
Figure 13B:
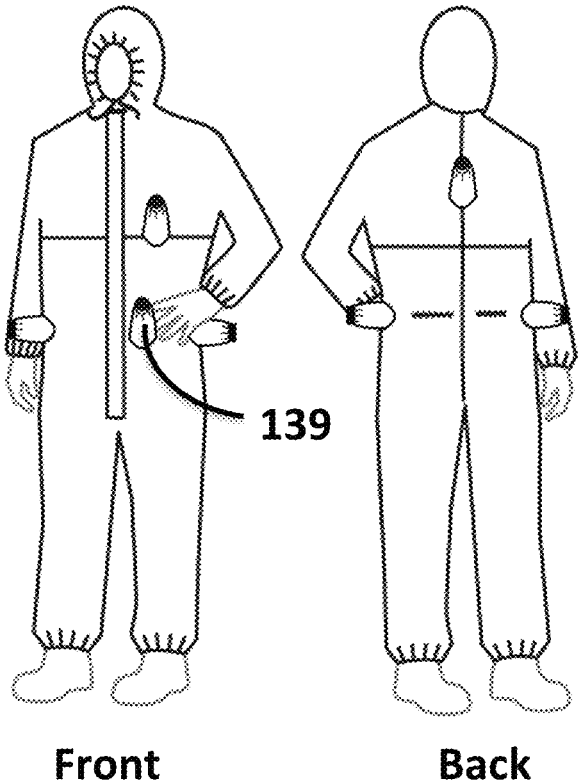
Figure 14A:
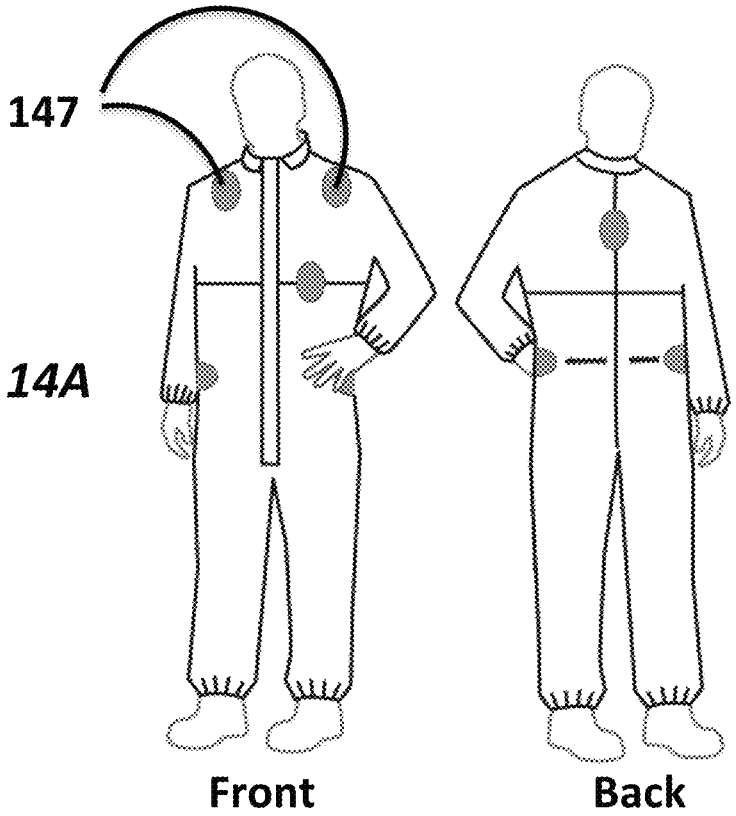
FIGS. 14A & 15A are illustrations of the orientations of six oval-shaped safety ring openings of front and back views of a protective coverall having a collar neck opening and a hooded neck opening, respectively.
Figure 14B:
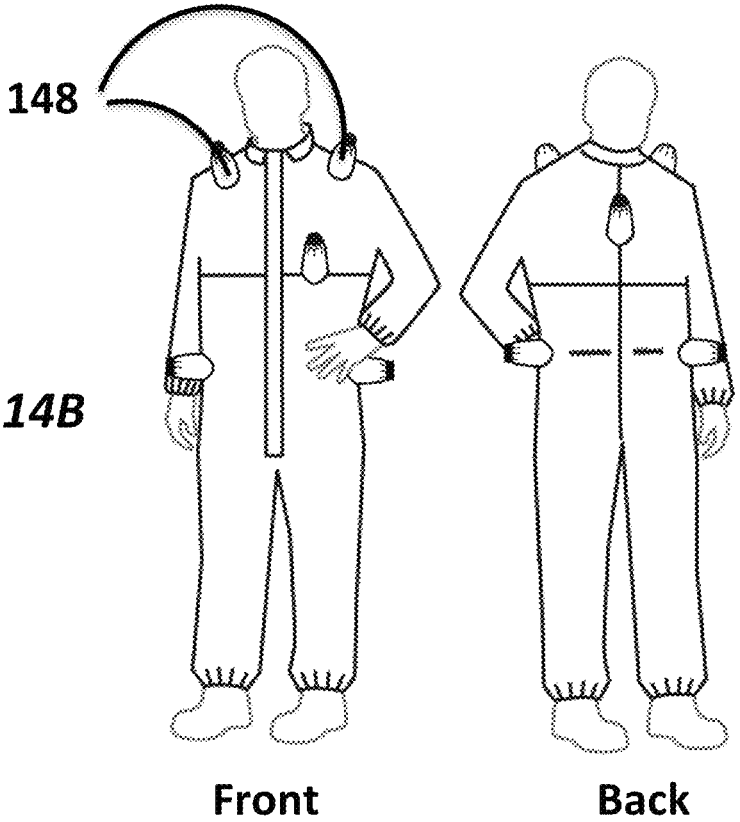
FIGS. 14B & 15B are illustrations of front and back views of embodiments of a protective coverall having a collar neck opening and a hooded neck opening, respectively, wherein each of the six oval-shaped safety ring openings of FIGS. 14A & 15A is provided with a safety ring sleeve having an elasticized cuff.
Figure 15A:
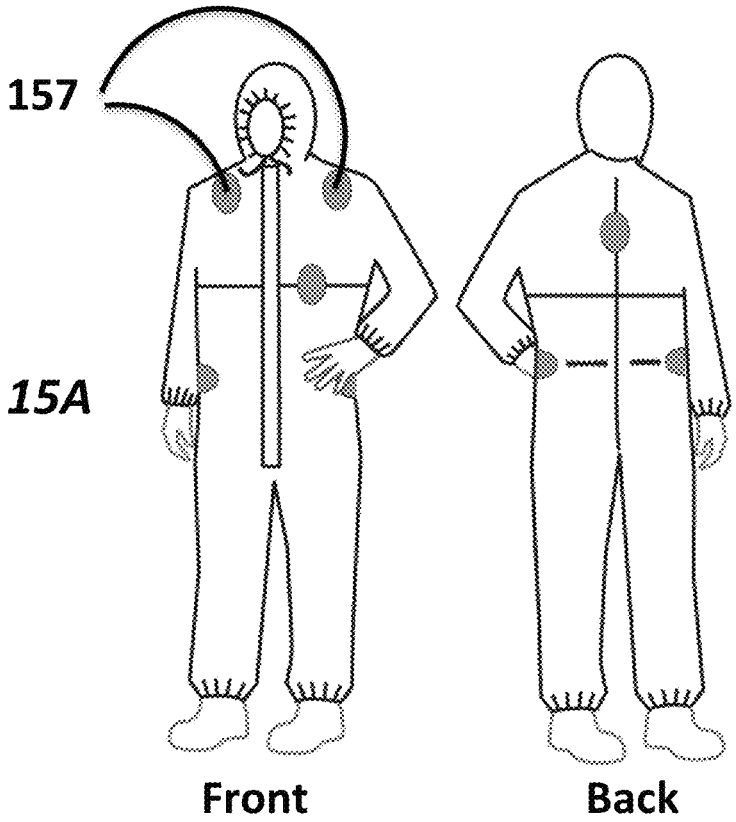
Figure 15B:
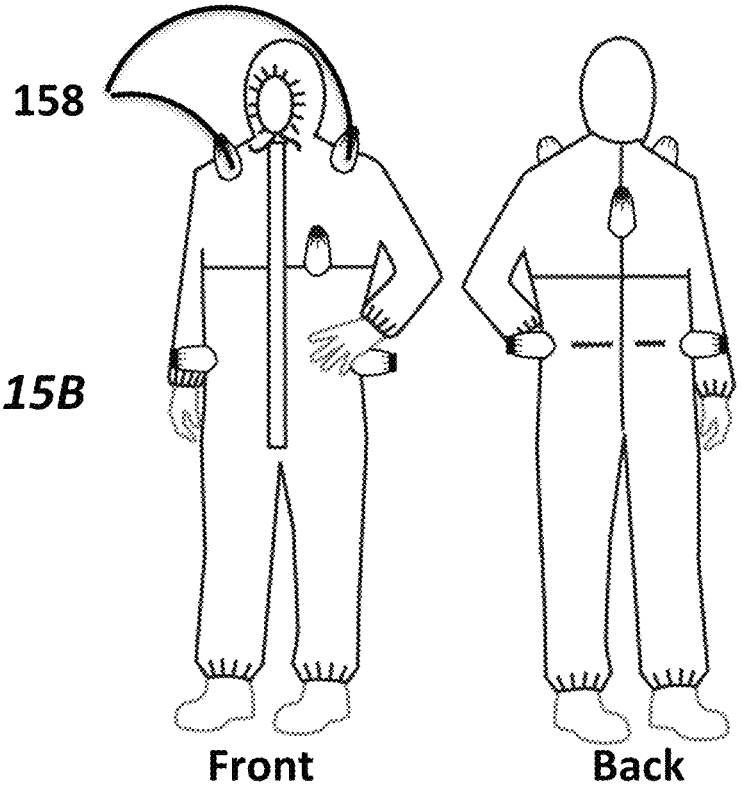
Figure 16A:
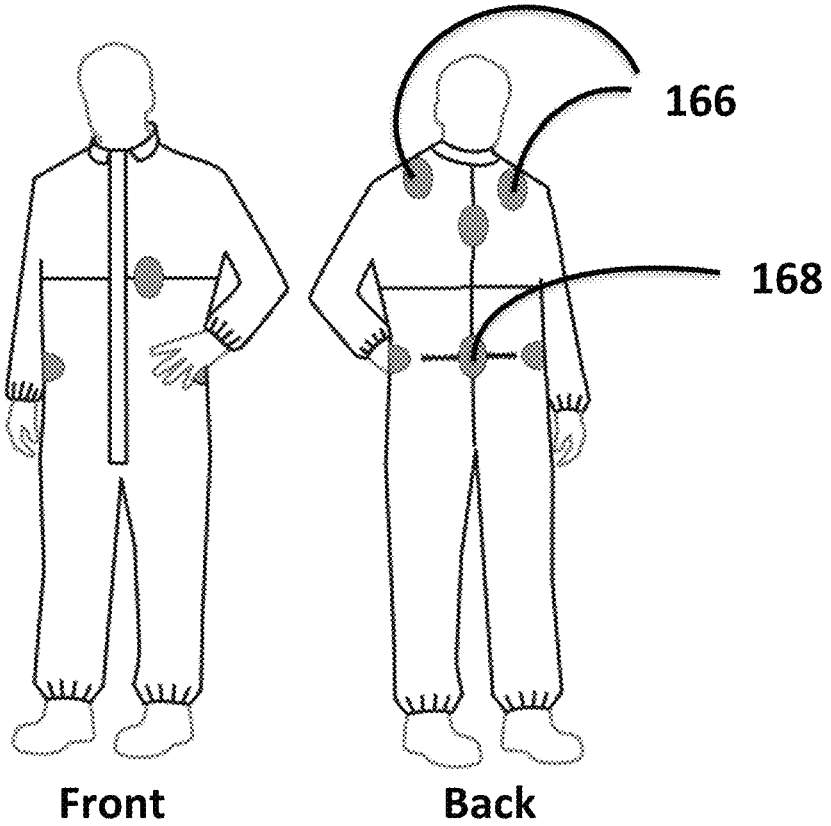
FIGS. 16A & 17A are illustrations of the orientations of seven oval-shaped safety ring openings of front and back views of a protective coverall having a collar neck opening and a hooded neck opening, respectively.
Figure 16B:
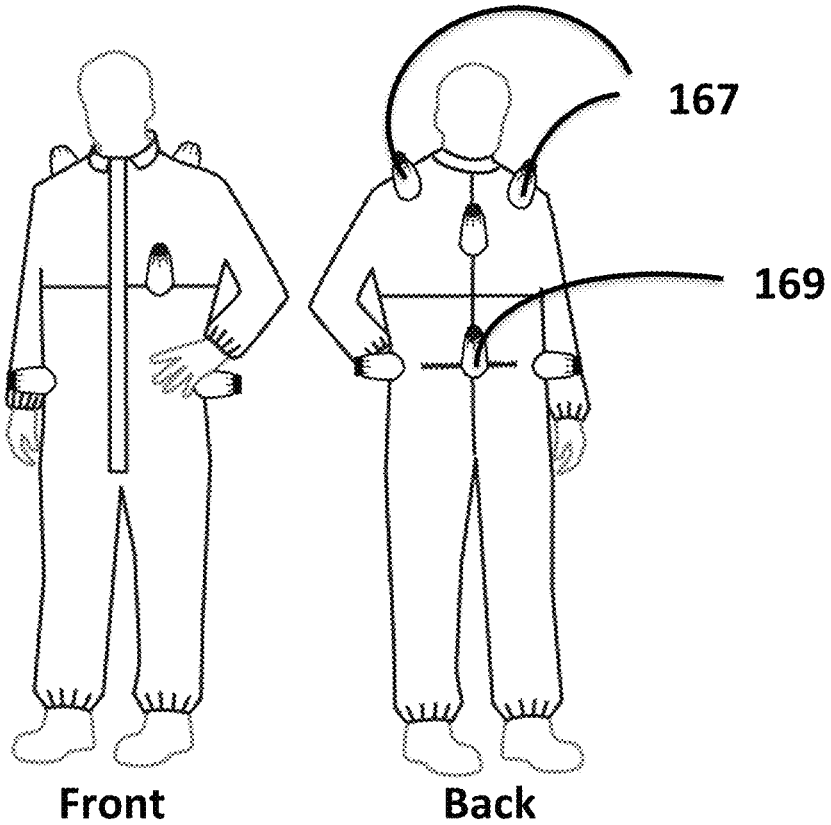
FIGS. 16B & 17B are illustrations of front and back views of embodiments of a protective coverall having a collar neck opening and a hooded neck opening, respectively, wherein each of the seven oval-shaped safety ring openings of FIGS. 16A & 17A is provided with a safety ring sleeve having an elasticized cuff.
Figure 17A:
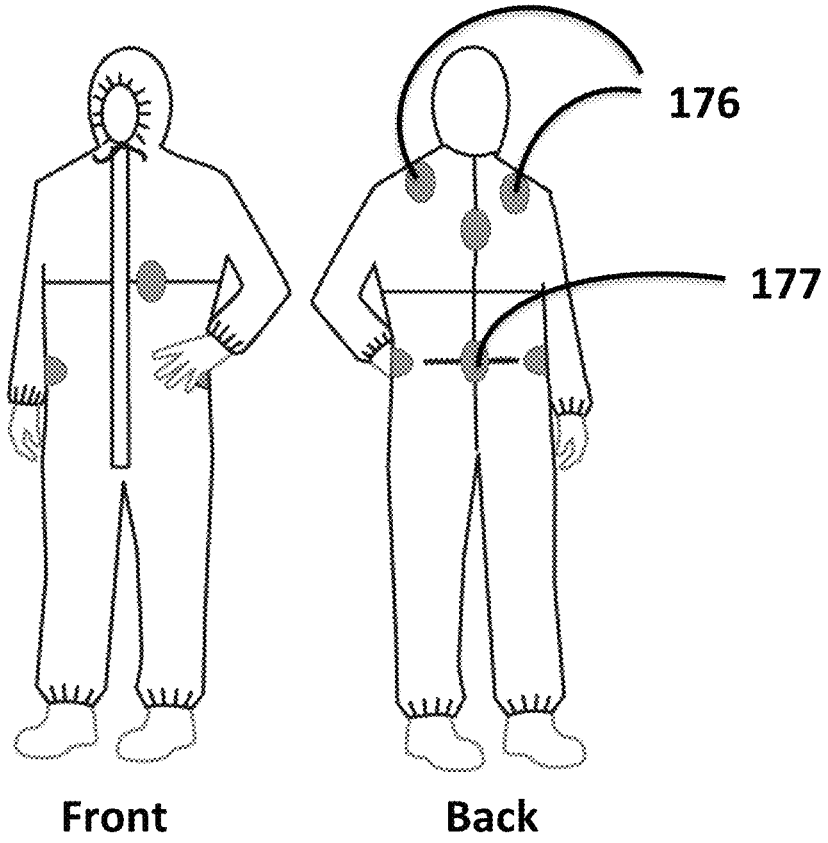
Figure 17B:
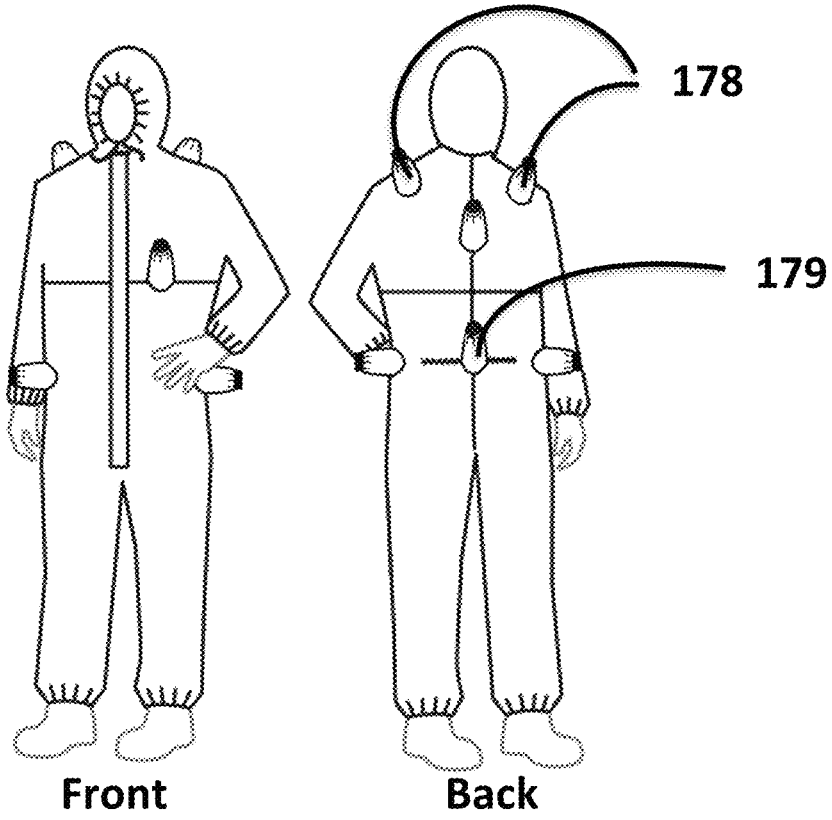

Additional figures showing possible orientations and placement of the safety ring openings are shown in FIGS. 12A through 17B. These figures are not intended to be an exhaustive listing or limiting, but simply to illustrate some of the wide variety of coveralls that can be made. For example, FIGS. 12A & 13A are illustrations of front and back views of protective coverall having a collar neck opening and a hooded neck opening, respectively, each having a total of five oval-shaped safety ring openings. FIGS. 12B & 13B are illustrations of front and back views of embodiments of protective coverall having a collar neck opening and a hooded neck opening, respectively, wherein each of the five oval-shaped safety ring openings of FIGS. 12A & 13A is provided with a safety ring sleeve having an elasticized cuff. FIGS. 14A & 15A are illustrations of front and back views of protective coverall having a collar neck opening and a hooded neck opening, respectively, each having a total of six oval-shaped safety ring openings. FIGS. 14B & 15B are illustrations of front and back views of embodiments of protective coverall having a collar neck opening and a hooded neck opening, respectively, wherein each of the six oval-shaped safety ring openings of FIGS. 14A & 15A is provided with a safety ring sleeve having an elasticized cuff. FIGS. 16A & 17A are illustrations of front and back views of protective coverall having a collar neck opening and a hooded neck opening, respectively, each having a total of seven oval-shaped safety ring openings. FIGS. 16B & 17B are illustrations of front and back views of embodiments of protective coverall having a collar neck opening and a hooded neck opening, respectively, wherein each of the seven oval-shaped safety ring openings of FIGS. 16A & 17A is provided with a safety ring sleeve having an elasticized cuff.

Specifically, in some embodiments, the protective coverall, having a plurality of safety ring openings with each safety ring opening provided with a safety ring sleeve, can comprise a third waist safety ring opening positioned on the body portion in the center waist area or between the first and second hip or waist safety ring openings, the third waist safety ring opening being either on the front side or the back side of the coverall, along with its associated safety ring sleeve. FIGS. 12A-B & 13A-B are example illustrations of this third waist safety ring opening (128, 138) and associated ring sleeve (129, 139) when it is on the front of the coverall, while FIGS. 16A-B & 17A-B are example illustrations of this third waist safety ring opening (168, 178) and associated ring sleeve (169, 179) when it is on the back of the coverall.

In some embodiments, the protective coverall having a plurality of safety ring openings with each safety ring opening provided with a safety ring sleeve can comprise, in addition to a first front ring opening with a first front safety ring sleeve (preferably for receiving a first front safety ring attached to the front area of a body harness), a second front ring opening with a second front safety ring sleeve for receiving a second front safety ring attached to the front area of the body harness. In some embodiments, the first and second front safety ring openings for the first and second front safety ring sleeves are symmetrically positioned on the body portion on the upper front of the coverall. Coverall versions including the first and second front safety ring openings (147-157) for the first and second front safety ring sleeves (148-158) are illustrated in FIGS. 14A-B & 15A-B.

In some embodiments, the protective coverall, having a plurality of safety ring openings with each safety ring opening provided with a safety ring sleeve, can comprise a first back ring opening with a first back safety ring sleeve (preferably for receiving a first back safety ring attached to the back area of a body harness), a second back ring opening with a second back safety ring sleeve for receiving a second back safety ring attached to the back area of the body harness. In some embodiments, the first and second back safety ring openings for the first and second back safety ring sleeves are symmetrically positioned on the body portion on the upper back of the coverall. Coverall versions including the first and second front safety ring openings (166-176) for the first and second front safety ring sleeves (167-177) are illustrated in FIGS. 16A-B & 17A-B.

The protective coverall can have additional desirable features. For example, in some preferred embodiments, the at least one torso opening for donning the coverall is a vertical opening horizontally centered on the front side of the coverall. The coverall further preferably comprises a fastener for opening and closing said vertical opening. Additionally, as shown in FIGS. 1 & 2 and other figures, it is preferred to have a closing flap (19,29) over the closed fastener; although if the closing flap is not present the fastener is still preferably horizontally centered on the front side of the coverall.

In some embodiments, when the vertical opening horizontally centered on the front side of the coverall with a fastener is present, and additionally a first front safety ring sleeve is present, the first front safety ring sleeve (or any other front safety ring) can be horizontally offset on the front of the coverall from the centered vertical opening and fastener. In this instance, the first ring opening is also necessarily horizontally offset on the front of the coverall from the centered vertical opening and fastener. The first front safety ring sleeve (16, 26) shown in FIGS. 1 & 2 and other figures is representative and is duplicated on several of the drawing embodiments.

Alternatively, in some embodiments, when first front safety ring sleeve (and first ring opening) is present and is horizontally centered on the front side of the coverall, and a vertical opening with a fastener for the coverall is additionally present, the vertical opening with a fastener can be horizontally offset on the front of the coverall from a centered location. That is, the location of the vertical opening and fastener is horizontally offset on the front of the coverall from the first front safety ring opening and first front safety ring sleeve.

Figure 18A:
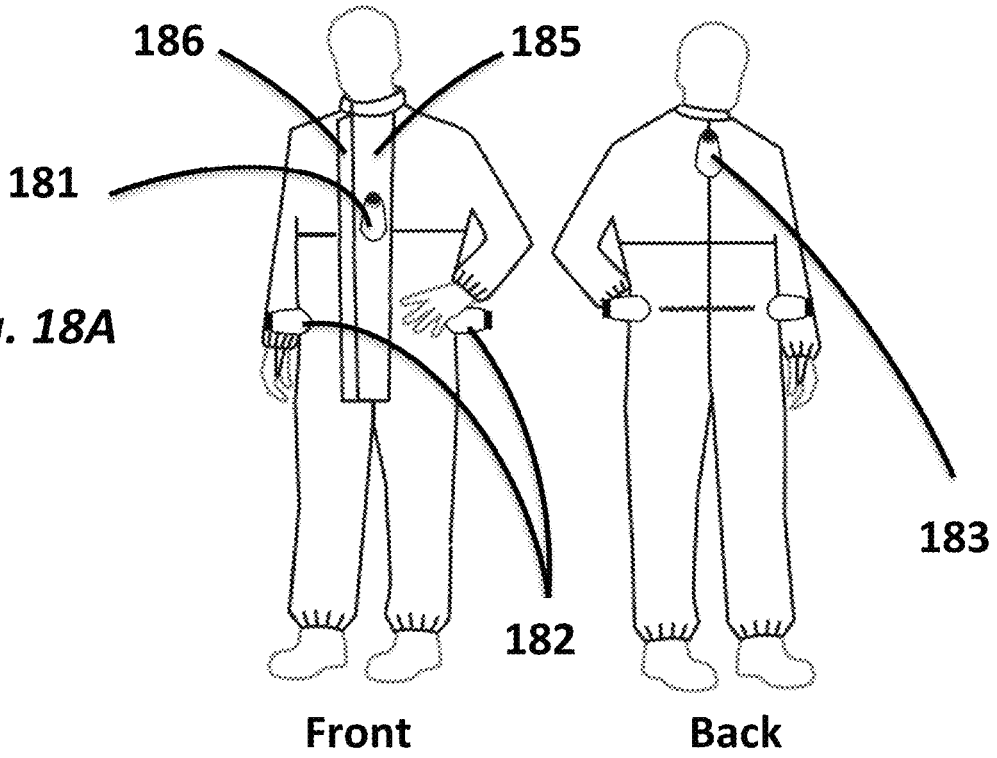
FIGS. 18A & 18B are illustrations of front and back views of a coverall having a collar neck opening and a hooded neck opening, respectively, showing a total of four cone-shaped or conical safety ring sleeves; each safety ring sleeve further ending in an elasticized cuff, wherein one of the safety ring sleeves is positioned in the center front of the body portion of the coverall with both the vertical opening with fastener and closing flap being horizontally offset from the vertical centerline of the body portion.
Figure 18B:
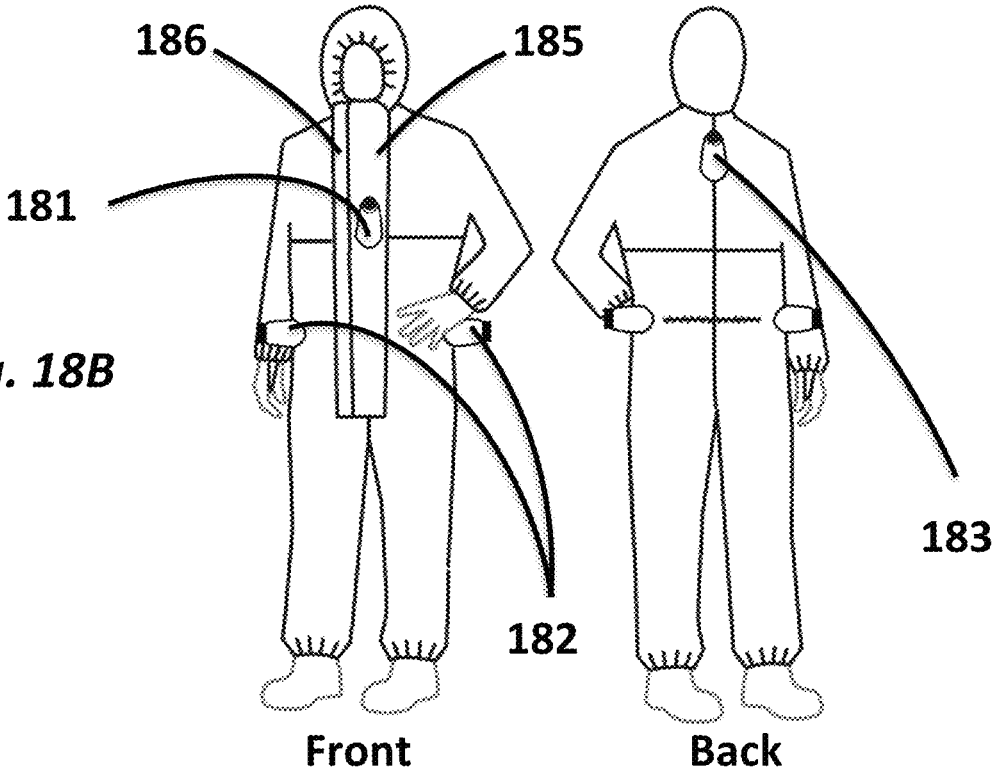

FIGS. 18A & 18B are front and back illustrations of a coverall having a collar neck opening and a coverall having a hooded neck opening, respectively, showing a total of four conical or cone-shaped safety ring sleeves. Each safety ring sleeve further ends in an elasticized cuff. One of the safety ring sleeves is positioned on the vertical centerline of the upper front of the body portion, with the vertical opening with fastener being horizontally offset from the vertical centerline of the body portion. As used herein unless otherwise specified, when location terms are used herein, as in items that located at or on or in the "center of the upper front of the body portion", or at or on "the vertical centerline of the upper front of the body portion", it is meant these items are located at or no or in the center of the body portion surface or at or on or in the vertical centerline of the upper front of the body portion surface, as the body portion is necessarily a hollow structure. Likewise, as disclosed herein, it is understood that a safety ring sleeve at the "center waist" is located at or on or in the vertical centerline of the hip-waist area of the body portion surface.

As shown in FIGS. 18A & 18B, specifically, a single center upper front safety ring sleeve 181 on the centerline of the front body portion surface is shown with two hip waist safety ring sleeves 182 (the single hip waist safety ring sleeve at each hip can be seen in both the front and back views), and a single center upper back safety ring sleeve 183, which is also shown on the centerline of the back body portion surface. Specifically, in the embodiment shown in these figures, the single center upper front safety ring sleeve 181 is shown essentially located at the center of the front surface of the body portion; while single center upper back safety ring sleeve 183 is shown positioned higher than the center of the back surface of the body portion. In this embodiment, the coverall fastener is closed, and the coverall includes an additional optional center fabric panel 185 located on the body portion for attachment of the center front safety ring sleeve 181. Additionally, the preferred closing flap 186 covers the closed fastener (not shown, as it is covered by the closing flap); although if the closing flap is not present the fastener is still preferably horizontally centered on the front side of the coverall. While the embodiment shown in these figures illustrates the closing flap 186 covering the vertical opening with fastener to the right of the center front safety ring sleeve 181 (on the right of the chest of the wearer of the coverall); the closing flap, vertical opening, and fastener could be positioned on the other side of the center front safety ring sleeve (i.e., on the left of the chest of the wearer of the coverall). While in these figures the center front safety ring sleeve is shown on the horizontal seam line at the chest of the coverall, this is just one possibility and that seam could be located higher or lower on the chest, based on the size of the coverall, and not in line with the center front safety ring sleeve.

Additionally, while the closing flap covering the vertical opening and fastener is shown on the body portion parallel with the centerline of the body portion; that is, parallel with a line running from the center of the neck of the coverall to the crotch of the coverall, the orientation of the closing flap covering the vertical opening is not limited and could be more or less angled from vertical. For example, the closing flap along with the vertical front opening and fastener could angularly traverse the body portion from the right chest or shoulder area toward the left hip-waist area, or from the left chest or shoulder area towards the right hip-waist area.

In some embodiments, the protective coverall is suitable for use over a body harness worn by a person to support that person with safety lines or ropes attached to that body harness during an activity or if the person should fall, with the body harness having a plurality of safety rings suitable for attaching the body harness to a plurality of lines or ropes, the body harness having an upper front area worn on an upper front of a body, a back area worn on a back of the body, and a hip-waist (hip or waist) area worn in a hip or waist area of the body. The coverall has an interior surface for facing the body harness when worn by the person over the body harness and the coverall having an exterior surface for facing an exterior environment; and the coverall further having a body portion for covering a person's torso when the coverall is worn by the person; the body portion having at least one torso opening for donning the coverall and a neck opening for a person's head and neck.

The body portion has a plurality of openings for a person's limbs, including a first opening ending in a first sleeve for receiving a portion of a person's right arm when the person wears the coverall, and a second opening ending in a second sleeve for receiving a portion of a person's left arm when the person wears the coverall, with each of the sleeves further having an opening for a person's wrist and hand. The body portion also has a third opening ending in a first pant sleeve for receiving a portion of a person's right leg when the person wears the coverall, and a fourth opening ending in a second pant sleeve for receiving a portion of a person's left leg when the person wears the coverall, with each of the pant sleeves further having an opening for a person's ankle and foot. The body portion additionally has a plurality of safety ring openings with each safety ring opening provided with a safety ring sleeve for receiving a safety ring attached to the body harness, each safety ring sleeve further ending in an elasticized cuff. Each elasticized cuff has a size compatible with the size of the safety ring received in the safety ring sleeve, such that the elasticized cuff can expand to allow the safety ring to extend through the cuff, or partially extend through the cuff, to the exterior environment of the coverall, and hold the safety ring in that position. Additionally, in a preferred embodiment, the plurality of safety ring openings includes i) a back ring opening with back safety ring sleeve for receiving a back safety ring attached to the back area of the body harness, ii) a front ring opening with first front safety ring sleeve for receiving a front safety ring attached to the upper front area of the body harness, iii) a first hip or waist safety ring opening for a first hip or waist safety ring sleeve for receiving a first hip or waist safety ring attached to the hip or waist area of the body harness, and iv) a second hip or waist safety ring opening for a second hip or waist safety ring sleeve for receiving a second hip or waist safety ring attached to the hip or waist area of the body harness;

wherein the first and second hip or waist safety ring openings for the first and second hip or waist safety ring sleeves are symmetrically positioned in a hip or waist area of the coverall.

In some embodiments, the protective coverall can further comprise v) a third waist safety ring opening and associated safety ring sleeve positioned on the body portion between the first and second hip or waist safety ring openings, the third waist safety ring opening and sleeve being either on the front side or the back side of the coverall.

In some embodiments, the protective coverall has at least one safety ring sleeve that is cone-shaped, with the widest opening of the cone being the safety ring opening in the body portion and narrowest opening of the cone being the elasticized cuff. In some embodiments, the at least one safety ring sleeve comprises two sleeve plies, and in some embodiments the elasticized cuff is a free-floating elastic band encapsulated by the two sleeve plies.

In some embodiments, the protective coverall has at least one torso opening for donning the coverall that is a vertical opening horizontally centered on the body portion on the front side of the coverall, and the coverall further include a fastener for opening and closing said vertical opening. In some embodiments, the ii) front ring opening with first front safety ring sleeve is horizontally offset on the front side of the coverall from the vertical opening and fastener. The neck opening and the at least one torso opening may be connected when the fastener is not closed.

In some embodiments, the protective coverall has at least one torso opening for donning the coverall that is a vertical opening horizontally offset on the body portion on the front side of the coverall from a ii) front ring opening with first front safety ring sleeve that located on the centerline of the body portion surface on the front side of the coverall; the coverall further include a fastener for opening and closing said vertical opening. The neck opening and the at least one torso opening may be connected when the fastener is not closed.

In some embodiments the protective coverall is a single-use garment, that is, it is used only once and then disposed of or responsibly recycled. In some embodiments the protective coverall is a limited-use garment that is used, decontaminated, and re-used for a limited number of times; for example, 2 to 5 times.

The protective coverall can preferably be made from a protective apparel fabric. The term "protective apparel fabric" is meant to include a wide variety of protective garment fabrics, barrier fabrics, laminates, and films. The term "protective apparel fabric" also includes nonwoven and/or woven fabrics and laminates of such materials with films or multilayer films. In some embodiments, the protective fabric comprises a chemically-resistant outer layer. In some preferred embodiments the protective apparel fabric, and therefore the coverall material, is a multilayer-film-and-nonwoven laminate. In some embodiments the overall material is a nonwoven that resists penetration by liquids and/or particulates, such as a nonwoven like DuPont™ TYVEK® spunbonded polyethylene, or other types of nonwovens, like polyester or polypropylene, etc., spunbonded and melt-blown sheets and laminates, and other nonwoven constructions, including coated and film-laminated versions. In some embodiments the protective fabric is flame resistant or provided with a flame retardant; in some embodiments the protective fabric is flame resistant or provided with a flame retardant in addition to providing particulate, liquid, and/or chemical-or bio-challenge protection. One preferred protective coverall fabric is Dupont™ TYCHEM® 2000 fabrics, which feature a coated TYVEK® fabric. These fabrics provide barrier protection against a wide range of inorganic chemical and biological hazards yet are lightweight and comfortable. Other useful fabrics can include other film-laminated TYVEK® fabric styles, and fabrics such as those used in DuPont™ TYCHEM® 6000 FR, DuPont™ TYCHEM® ThermoPro, and DuPont™ PROSHIELD® SFR. In addition, other useful protective coverall fabrics that protect against a wide variety of threats can be used and include but are not limited to those generally disclosed in U.S. Pat. No. 5,626,947 (Hauer et al.); 4,855,178 (Langley); U.S. Pat. No. 4,272,851 (Goldstein); U.S. Pat. No. 4,772,510 (McClure); U.S. Pat. No. 5,035,941 (Blackburn); U.S. Pat. No. 4,214,321 (Nuwayser); U.S. Pat. No. 4,920,575 (Bartasis); U.S. Pat. No. 5,162,148 (Boye); and 4,833,010 (Langley).

The invention claimed is:

1. Protective coverall suitable for use over a body harness worn by a person to support that person with safety lines or ropes attached to that body harness during an activity or if the person should fall, with the body harness having a plurality of safety rings suitable for attaching the body harness to a plurality of lines or ropes, the body harness having an upper front area worn on an upper front of a body, a back area worn on a back of the body, and a hip or waist area worn in a hip or waist area of the body;

the coverall having an interior surface for facing the body harness when worn by the person over the body harness and the coverall having an exterior surface for facing an exterior environment; the coverall further having a front side and a back side;

the coverall further having a body portion for covering a person's torso when the coverall is worn by the person; the body portion having at least one torso opening for donning the coverall and a neck opening for a person's head and neck;

the body portion having a plurality of openings for a person's limbs, including a first opening ending in a first sleeve for receiving a portion of a person's right arm when the person wears the coverall, and a second opening ending in a second sleeve for receiving a portion of a person's left arm when the person wears the coverall, with each of the sleeves further having an opening for a person's wrist and hand;

the body portion also having a third opening ending in a first pant sleeve for receiving a portion of a person's right leg when the person wears the coverall, and a fourth opening ending in a second pant sleeve for receiving a portion of a person's left leg when the person wears the coverall, with each of the pant sleeves further having an opening for a person's ankle and foot;

wherein the body portion additionally has a plurality of safety ring openings with each safety ring opening provided with a safety ring sleeve for receiving a safety ring attached to the body harness, each safety ring sleeve further ending in an elasticized cuff; and wherein each safety ring sleeve with elasticized cuff has an overall length of 5.75 to 16 inches, as measured parallel to a centerline of each safety ring sleeve.

2. The protective coverall of claim 1, wherein the elasticized cuff has a relaxed circumference of about 3 to 5 inches.

3. The protective coverall of claim 1, wherein each elasticized cuff has a size compatible with the size of the safety ring received in the safety ring sleeve, such that the elasticized cuff can:

a) expand to allow the safety ring to extend through the cuff, or partially extend through the cuff, to the exterior environment of the coverall, and b) hold the safety ring in that position.

4. The protective coverall of claim 1, wherein the plurality of safety ring openings with each safety ring opening provided with a safety ring sleeve for receiving a safety ring attached to the body harness includes:

a back ring opening with back safety ring sleeve for receiving a back safety ring attached to the back area of the body harness, and a first front ring opening with first front safety ring sleeve for receiving a front safety ring attached to the upper front area of the body harness.

5. The protective coverall of claim 4, wherein the plurality of safety ring openings with each safety ring opening provided with a safety ring sleeve for receiving a safety ring attached to the body harness includes:

a second front ring opening with a second front safety ring sleeve for receiving a second front safety ring attached to the upper front area of the body harness.

6. The protective coverall of claim 5 wherein the first and second front safety ring openings with the first and second front safety ring sleeves are symmetrically positioned on the body portion on an upper front of the coverall.

7. The protective coverall of claim 1, wherein the plurality of safety ring openings with each safety ring opening provided with a safety ring sleeve for receiving a safety ring attached to the body harness includes:

a first hip or waist safety ring opening with a first hip or waist safety ring sleeve for receiving a first hip or waist safety ring attached to the hip or waist area of the body harness, and optionally, a second hip or waist safety ring opening with a second hip or waist safety ring sleeve for receiving a second hip or waist safety ring attached to the hip or waist area of the body harness.

8. The protective coverall of claim 7 wherein both the first and second hip or waist safety ring openings with first and second hip safety ring sleeves are present, and the first and second hip or waist safety ring openings for the first and second hip or waist safety ring sleeves are symmetrically positioned on the body portion in a hip or waist area of the coverall.

9. The protective coverall of claim 7 further comprising a third waist safety ring opening in the body portion, with third waist safety ring sleeve positioned between the first and second hip or waist safety ring openings and sleeves, the third waist safety ring opening with third waist safety ring sleeve being either on the front side or the back side of the coverall.

10. The protective coverall of claim 1, wherein the plurality of safety ring openings with each safety ring opening provided with a safety ring sleeve for receiving a safety ring attached to the body harness includes a center waist safety ring opening in the body portion at the center of the waist of the coverall, on either the front or the back of the coverall, with a center waist safety ring sleeve for receiving a center waist safety ring attached to the hip or waist area of either the front or back of the body harness.

11. The protective coverall of claim 1, wherein at least one safety ring opening in the body portion has an oval shape.

12. The protective coverall of claim 1, wherein at least one safety ring sleeve is cone-shaped, with the widest opening of the cone-shaped sleeve being the safety ring opening in the body portion and narrowest opening of the cone-shaped sleeve being the elasticized cuff.

13. The protective coverall of claim 1, wherein at least one safety ring sleeve comprises two sleeve plies, and the elasticized cuff is a free-floating elastic band encapsulated by the two sleeve plies.

14. The protective coverall of claim 1, wherein the body portion further comprises a hood.

15. The protective coverall of claim 14, wherein the at least one torso opening for donning the coverall is a vertical opening horizontally centered on the body portion on the front side of the coverall, and the coverall further comprising a fastener for opening and closing said vertical opening.

16. The protective coverall of claim 15 wherein said front ring opening with first front safety ring sleeve is horizontally offset on the front side on the body portion of the coverall from the horizontally centered vertical opening and fastener.

17. The protective coverall of claim 1, wherein the at least one torso opening for donning the coverall is a vertical opening horizontally centered on the body portion on the front side of the coverall, and the coverall further comprising a fastener for opening and closing said vertical opening.

18. The protective coverall of claim 17 wherein if the first front ring opening with first front safety ring sleeve is present, it is horizontally offset on the body portion on the front of the coverall from the horizontally centered vertical opening and fastener.

19. The protective coverall of claim 1, wherein the plurality of safety ring openings with each safety ring opening provided with a safety ring sleeve for receiving a safety ring attached to the body harness includes:

a first front ring opening with first front safety ring sleeve for receiving a front safety ring attached to the upper front area of the body harness, the first front ring opening with first front safety ring sleeve being horizontally centered on the body portion on the front side of the coverall.

20. The protective coverall of claim 19 wherein the at least one torso opening for donning the coverall is a vertical opening on the body portion on the front side of the coverall, the coverall further including a fastener for opening and closing said vertical opening, wherein said vertical opening is horizontally offset on the body portion on the front side of the coverall from said horizontally centered first front ring opening with first front safety ring sleeve.

21. Protective coverall suitable for use over a body harness worn by a person to support that person with safety lines or ropes attached to that body harness during an activity or if the person should fall, with the body harness having a plurality of safety rings suitable for attaching the body harness to a plurality of lines or ropes, the body harness having an upper front area worn on an upper front of a body, a back area worn on a back of the body, and a hip or waist area worn in a hip or waist area of the body;

the coverall having an interior surface for facing the body harness when worn by the person over the body harness and the coverall having an exterior surface for facing an exterior environment;

the coverall further having a body portion for covering a person's torso when the coverall is worn by the person; the body portion having at least one torso opening for donning the coverall and a neck opening for a person's head and neck;

the body portion having a plurality of openings for a person's limbs, including a first opening ending in a first sleeve for receiving a portion of a person's right arm when the person wears the coverall, and a second opening ending in a second sleeve for receiving a portion of a person's left arm when the person wears the coverall, with each of the sleeves further having an opening for a person's wrist and hand;

the body portion also having a third opening ending in a first pant sleeve for receiving a portion of a person's right leg when the person wears the coverall, and a fourth opening ending in a second pant sleeve for receiving a portion of a person's left leg when the person wears the coverall, with each of the pant sleeves further having an opening for a person's ankle and foot;

wherein the body portion additionally has a plurality of safety ring openings with each safety ring opening provided with a safety ring sleeve for receiving a safety ring attached to the body harness, each safety ring sleeve further ending in an elasticized cuff, wherein the plurality of safety ring openings includes i) a back ring opening with back safety ring sleeve for receiving a back safety ring attached to the back area of the body harness, ii) a front ring opening with first front safety ring sleeve for receiving a front safety ring attached to the upper front area of the body harness, iii) a first hip or waist safety ring opening with a first hip or waist safety ring sleeve for receiving a first hip or waist safety ring attached to the hip or waist area of the body harness, and iv) a second hip or waist safety ring opening with a second hip or waist safety ring sleeve for receiving a second hip or waist safety ring attached to the hip or waist area of the body harness;

wherein the first and second hip or waist safety ring openings and the first and second hip or waist safety ring sleeves are symmetrically positioned on the body portion in a hip or waist area of the coverall; and wherein each safety ring sleeve with elasticized cuff has an overall length of 5.75 to 16 inches, as measured parallel to a centerline of each safety ring sleeve.

22. The protective coverall of claim 21, wherein the elasticized cuff has a relaxed circumference of about 3 to 5 inches.

23. The protective coverall of claim 21, wherein each elasticized cuff has a size compatible with the size of the safety ring received in the safety ring sleeve, such that the elasticized cuff can:

a) expand to allow the safety ring to extend through the cuff, or partially extend through the cuff, to the exterior environment of the coverall, and b) hold the safety ring in that position.

24. The protective coverall of claim 21, further comprising v) a third waist safety ring opening in the body portion, with a third waist safety ring sleeve positioned between the first and second hip or waist safety ring openings and sleeves, the third waist safety ring opening with third waist safety ring sleeve being either on the front side or the back side of the coverall.

25. The protective coverall of claim 21, wherein at least one safety ring sleeve is cone-shaped, with the widest opening of the cone-shaped sleeve being the safety ring opening in the body portion and narrowest opening of the cone-shaped sleeve being the elasticized cuff.

26. The protective coverall of claim 25 wherein the at least one safety ring sleeve comprises two sleeve plies, and the elasticized cuff is a free-floating elastic band encapsulated by the two sleeve plies.

27. The protective coverall of claim 21, wherein the front ring opening with first front safety ring sleeve for receiving a front safety ring attached to the upper front area of the body harness is horizontally centered on the body portion on the front side of the coverall.

28. The protective coverall of claim 27 wherein the at least one torso opening for donning the coverall is a vertical opening on the body portion on the front side of the coverall, the coverall further including a fastener for opening and closing said vertical opening, wherein said vertical opening is horizontally offset on the body portion on the front side of the coverall from said horizontally centered first front ring opening with first front safety ring sleeve.

* * * * *